US008936492B2

(12) United States Patent
Ho

(10) Patent No.: US 8,936,492 B2
(45) Date of Patent: Jan. 20, 2015

(54) MULTIPLE-USE ELECTRICAL CONNECTOR

(75) Inventor: Yi-Tse Ho, Taipei Hsien (TW)

(73) Assignee: Molex Incorporated, Lisle, IL (US)

( * ) Notice: Subject to any disclaimer, the term of this patent is extended or adjusted under 35 U.S.C. 154(b) by 122 days.

(21) Appl. No.: 13/702,475

(22) PCT Filed: Jun. 7, 2011

(86) PCT No.: PCT/US2011/039478

§ 371 (c)(1),
(2), (4) Date: Mar. 18, 2013

(87) PCT Pub. No.: WO2011/156399

PCT Pub. Date: Dec. 15, 2011

(65) Prior Publication Data

US 2013/0171884 A1 Jul. 4, 2013

(30) Foreign Application Priority Data

Jun. 7, 2010 (TW) ..... 99118343 A
Jun. 7, 2010 (TW) ..... 99210780 U
Jun. 7, 2010 (TW) ..... 99210781 U
Jun. 7, 2010 (TW) ..... 99210782 U

(51) Int. Cl.
*H01R 24/00* (2011.01)
*H01R 12/72* (2011.01)
*H01R 24/62* (2011.01)
*H01R 27/00* (2006.01)

(52) U.S. Cl.
CPC ..... *H01R 24/00* (2013.01); *H01R 12/724* (2013.01); *H01R 24/62* (2013.01); *H01R 27/00* (2013.01)
USPC ..... 439/660

(58) Field of Classification Search
CPC ..... H01R 12/724
USPC ..... 439/660, 79
See application file for complete search history.

(56) References Cited

U.S. PATENT DOCUMENTS 6,666,696 B1 12/2003 Wu
7,422,488 B1 9/2008 Wu
7,517,253 B1 * 4/2009 Chiang ..... 439/660

(Continued)

FOREIGN PATENT DOCUMENTS

JP 05-220674 A 8/1993
JP 2007-088881 A 4/2007

(Continued)

OTHER PUBLICATIONS

International Search Report for PCT/US2011/039478, date Feb. 24, 2012.

*Primary Examiner* — Xuong Chung Trans
(74) *Attorney, Agent, or Firm* — Stephen L. Sheldon

(57) ABSTRACT

An electric connector comprising a housing, a tongue module, a plurality of first terminals, a plurality of second terminals and the terminals assembled in the housing and tongue, and a metal shell assembled in the housing. The tongue module is assembled in the housing, and those first terminals disposed in the tongue module by insert molding. Each first terminal has an extended part buried in the tongue module. The lower surface of the tongue module has a plurality of second terminal receiving slots between those first terminals. The pitch between the two adjacent first terminals is greater than the width of the second terminal receiving slot. The upper surface of the tongue module has a plurality of the terminal receiving slots.

10 Claims, 24 Drawing Sheets

(56) References Cited

U.S. PATENT DOCUMENTS

| | | | | |
|---|---|---|---|---|
| 8,308,513 | B2 * | 11/2012 | Hsu et al. | 439/626 |
| 8,323,057 | B2 * | 12/2012 | Ho | 439/660 |
| 8,465,299 | B2 * | 6/2013 | Ho | 439/79 |
| 8,475,216 | B2 * | 7/2013 | Tung et al. | 439/660 |
| 2008/0261448 | A1 | 10/2008 | Yi et al. | |
| 2008/0311801 | A1 | 12/2008 | Chen et al. | |
| 2009/0111330 | A1 | 4/2009 | Lin et al. | |

FOREIGN PATENT DOCUMENTS

| | | | |
|---|---|---|---|
| JP | 2008-224580 | A | 9/2008 |
| TW | M357748 | U | 5/2009 |

* cited by examiner

MULTIPLE-USE ELECTRICAL CONNECTOR

RELATED APPLICATIONS

This application claims priority to Taiwan Application No. 99118343, filed Jun. 7, 2010 and to Taiwan Application No. 99210781, filed Jun. 7, 2010 and to Taiwan Application No. 99210780, filed Jun. 7, 2010, and to Taiwan Application No. 99210782, filed Jun. 7, 2010, all of which are incorporated herein by reference in their entirety.

FIELD OF THE INVENTION

The present invention relates to an electric connector and the assembling method thereof and in particular, it refers to a compound electric connector for plugging in a plurality of plugs.

DESCRIPTION OF RELATED ART

The known electric connectors, such as Taiwan patent application number 97219170 (corresponding patent publication number US 2009/0111330A1 of the United States) disclose a socket electric connector into which the standard USB 2.0, USB 3.0 and ESATA connector can be respectively plugged, including an insulation housing, a metal shell covering the housing and a terminal module that is formed and that is separated from the housing. The terminal module has a set of insulators installed on the housing. The front ends of the insulators extend into a docking space in order to form a docking tongue, wherein the upper surface of the docking tongue forms the first docking surface and the lower surface forms a second docking surface. A plurality of the first type of terminals (ESATA connector terminals) are placed on the first docking surface. A plurality of the second type of terminals (standard USB 2.0 connector terminals) are placed on the first docking surface. A plurality of the third type of terminals (which fit the second type of terminals to jointly form USB 3.0 connector terminals) are positioned inside the insulators. The third type of terminals are best formed by using an integrated method with the terminal module and are roughly located in the center positions of the insulators. Thus, the third types of terminals are located between the first and second types of terminals and the front ends of the third types of terminals extend into the second docking surface and are exposed inside the second docking space.

The aforementioned known patents disclose USB 2.0, USB 3.0 and ESATA compound socket connectors and the third type of terminals (which fit the second type of terminals to jointly form USB 3.0 connector terminals) are buried inside the insulators and are integral to the terminal module. But, due to the fact that it is necessary to arrange three types of terminals on a thin terminal module (tongue), the space for such types of electric connector is very limited and in the thickness direction of the tongue, the three types of terminals must be staggered. The third type of terminals described above (USB 3.0 terminals) need to be located between the first type of terminals (ESATA connector terminals) and the second type of terminals (USB 2.0 terminals). Such a method of arrangement will substantially reduced the strength of the tongue, and in addition, the space for the elastic the formation of the USB 2.0 terminals is limited and cannot exceed the positions of the third types of terminals (USB 3.0 terminals) (interference will occur), thus again affecting the elastic formation capability of the terminals. In addition, an issue of bonding strength exists with the fixed composition between the separated terminal module (the tongue) and the insulators.

Also, the aforementioned patents did not discuss and disclose the manufacturability of these types of connectors as well as the composition and issues of ease of assembly. Consequentially, certain individuals would appreciate an improved connector.

BRIEF SUMMARY

An electric connector comprises an housing with a plurality of second terminal paths and third terminal paths. A tongue module, comprising a tongue module and a plurality of first terminals disposed in the tongue by insert molding, is positioned in the housing. Each of these first terminals has a first contact portion extending exposed in the front end section of the lower surface of the tongue and the first solder portion that extends out of the tongue. A plurality of second terminals are provided, each of the second terminals has a second contact portion and a second solder portion. A plurality of third terminals are also provided and each of the third terminals has a third contact portion and a third solder portion. The plurality of second and third terminals are positioned in the respective terminal paths. A metal shell assembled on the housing so as to provide a plug hole and a plug-in space in a front end that extends around the tongue module, wherein the plug hole extends inward. A plurality of second terminal receiving slots are placed between the lower surface of the tongue module and the first terminals. The pitch between the first extended parts of two adjacent first terminals is greater than the width of the receiving slots of the second terminals. The first solder portions of the first terminals extend out of the housing; the second terminals are correspondingly installed in the second terminal paths of the housing and extend into the receiving slots of the second terminals of the tongue module. The second contact portions of the second terminals are exposed out of the lower surface of the tongue module and the second solder portions extend out of the housing. A plurality of third terminal receiving slots are placed on the upper surface of the tongue module and the third terminals are correspondingly extend into the third terminal receiving slots. The third contact portions of the plurality of third terminals can be exposed out of the lower surface of the tongue module and the third solder portions can extend out of the housing.

BRIEF DESCRIPTION OF THE DRAWINGS

The detailed description is illustrated by way of example and not limited in the accompanying figures in which like reference numerals indicate similar elements and in which.

DETAILED DESCRIPTION

The detailed description that follows describes exemplary embodiments and is not intended to be limited to the expressly disclosed combination(s). Therefore, unless otherwise noted, features disclosed herein may be combined together to form additional combinations that were not otherwise shown for purposes of brevity.

The depicted disclosure discloses a plurality of first terminals disposed integrally in the tongue module by insert molding. The pitch between the first extended parts of the adjacent two first terminals is greater than the width of the receiving slots of the second terminals, so that the positions of the first terminals and the second terminals can get closer in the thickness direction of the tongue module and be overlapped in part of the spatial positions and can be staggered in the width direction of the surface of the tongue module, to allow sufficient spatial deformation and shift for the second terminals. Therefore, during the assembly of the second and third terminals, the occurrence of interference can be avoided, while at the same time increasing the pitch between the first terminals and the third terminals in the thickness direction of the tongue module. Thus, by increasing the thickness of the flesh between them, the strength of the tongue module is enhanced; in addition, the present invention provide an assembling method for electric connectors, so that the type of compound electric connectors can be easily manufactured and assembled.

Figure 1:
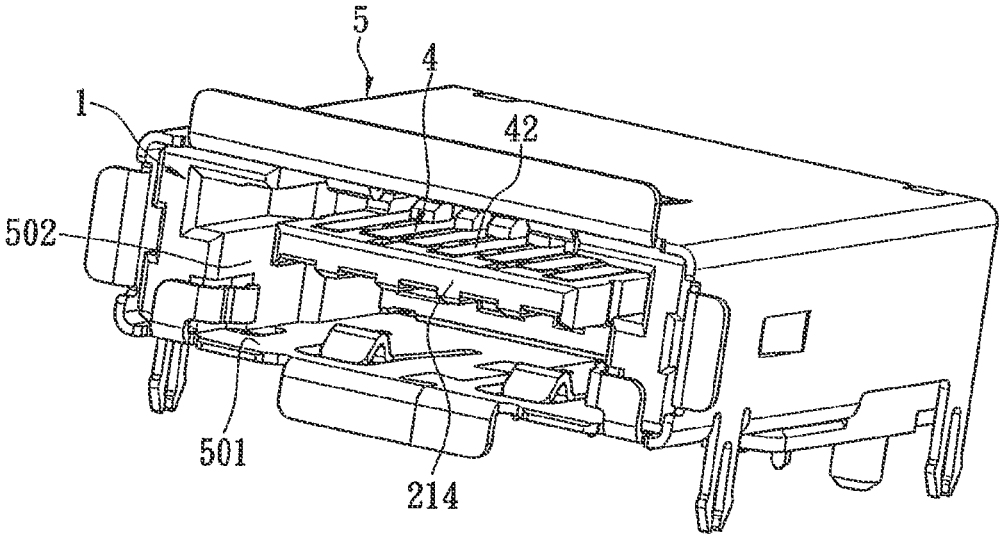
FIG. 1 illustrates a perspective view of a first embodiment of an electrical connector.
Figure 2:
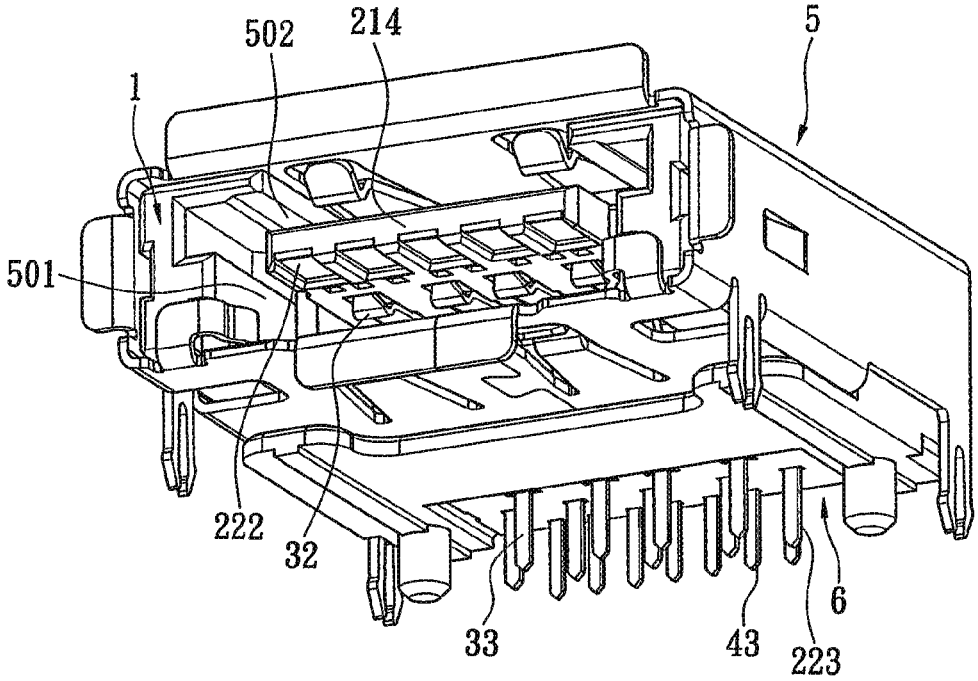
FIG. 2 illustrates another perspective view of the embodiment depicted in FIG. 1.

Referring to FIG. 1 and FIG. 2 the depicted disclosure provides an ESATA/USB 3.0 compound electric connector, whose front end has a shared plughole 501, used to at least provide the plug in connection for the ESATA plug, the USB 2.0 plug or a compound ESATA/USB plug. The ESATA referred to above is an abbreviation of External Serial Advanced Technology Attachment. USB is an abbreviation of Universal Serial Bus. The relevant connector norms and the norms published by the appropriate associations with reference standards will not be elaborated on herein.

Referring to FIGS. 1 through 18, a first embodiment of the electric connector is depicted. The electric connector comprises: a housing 1, which may be formed of an insulative material, a tongue module 2, which may also be formed of an insulative material, a plurality of first terminals 22, a plurality of second terminals 3, a plurality of the third terminals 4 and a metal shell 5.

The housing 1 comprises a base 11 and two arms 12 that are formed by extending forward from the two sides of the base 11. Base 11 forms a plurality of second terminal paths 13, an assembly slot 15 and a plurality of third terminal paths 14, wherein the second terminal paths 13, the assembly slot 15 and the third terminal paths 14 extend to the front and rear ends of the base 11, and the third terminal paths 14 and the second terminal paths 13 are respectively located on the upper and lower sides of the assembly slot 15.

Tongue module 2 comprises a tongue module 21 made of insulating materials and a plurality of first terminals 22 disposed in the tongue module 21 by insert molding. The tongue module 21 has a corresponding upper surface 211 and a lower surface 212.

As can be appreciated, each first terminal 22 has a first extended part 221 disposed inside of tongue module 21, a first contact portion 222 that extends from one end of extended parts 221 and that is exposed from the front end of lower part 212 of tongue module, as well as the first solder portions 223 that extend from the other end of first extended parts 221 and that extend out of tongue module 21. The first extended parts 221 of the first terminals 22 and the first contact portions 222 are on the same plane.

The lower surface 212 of the tongue module 21 has a plurality of second terminal receiving slots 23 between the first terminals 22. The pitch between the first extended parts 221 of the adjacent two first terminals is greater than the width of the receiving slots 23 of the second terminals. Upper surface 211 of tongue module 21 separately has a plurality of third terminal receiving slots 24. Second terminal paths 13 of the housing 1 are correspondingly connected to second terminal receiving slots 23 and the second terminals 3 are correspondingly assembled thereon. Third terminal paths 14 are correspondingly connected to third terminal receiving slots 24 and the third terminals 4 are correspondingly assembled thereon.

The upper surface 211 of the tongue module 21 has holding block 26 on at least one side of each third terminal receiving slot 24 that extends to the upper part of third terminal receiving slot 24 and that is used to hold down third terminal 4. Upper surface 211 of the tongue module 21 has a plurality of protruding ribs 27 beside the third terminal receiving slots 24. The holding blocks 26 are formed on the ribs 27.

Figure 3:
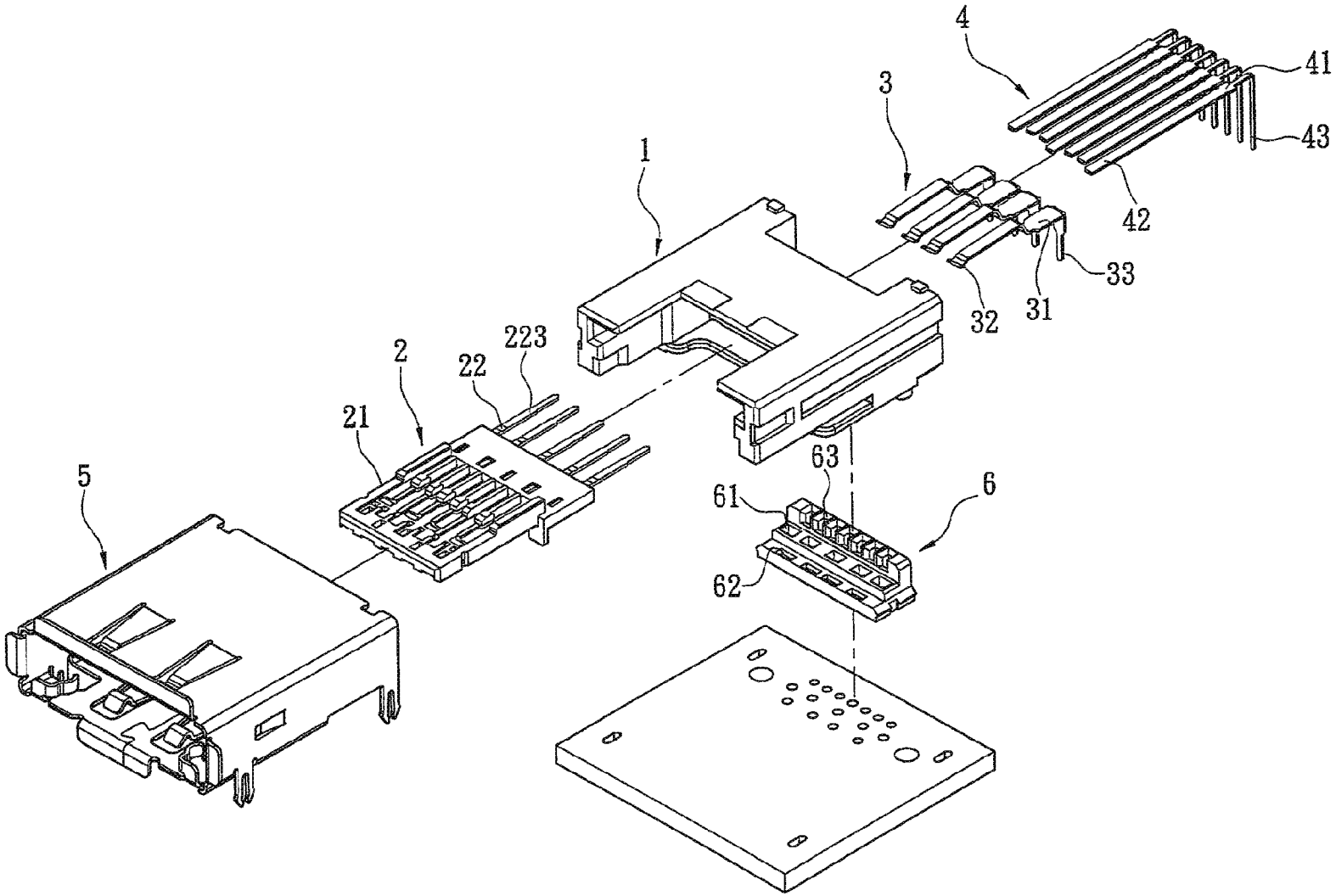
FIG. 3 illustrates a perspective exploded view of the embodiment depicted in FIG. 1.
Figure 4:
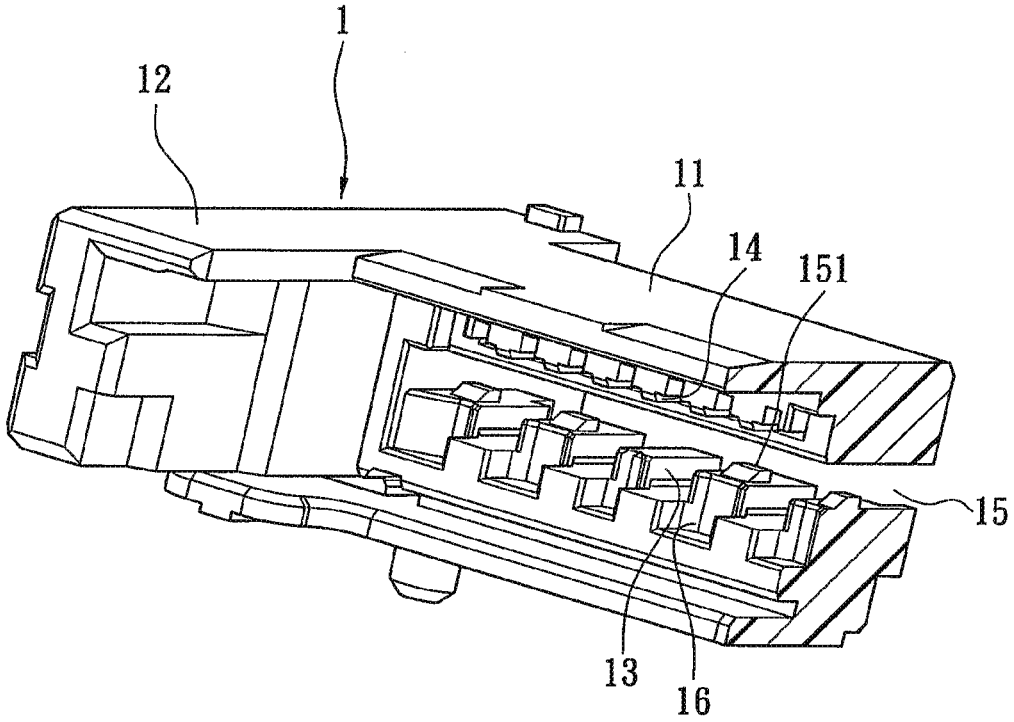
FIG. 4 illustrates a cross-sectional perspective view of an embodiment of the housing depicted in FIG. 1.
Figure 5:
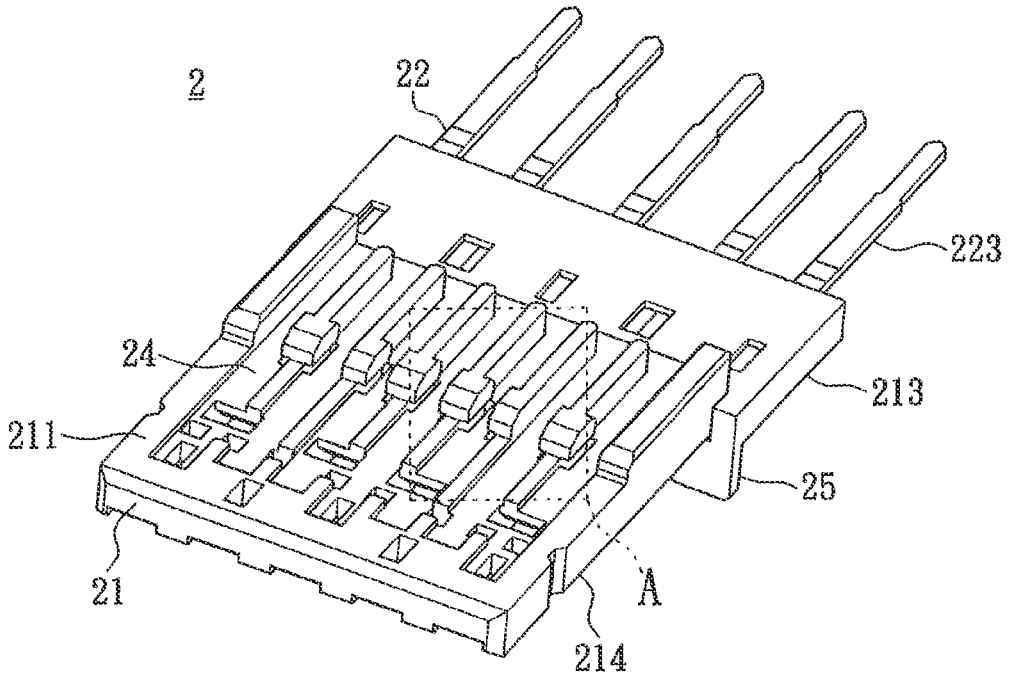
FIG. 5 illustrates a perspective view of an embodiment of a tongue module.
Figure 6:
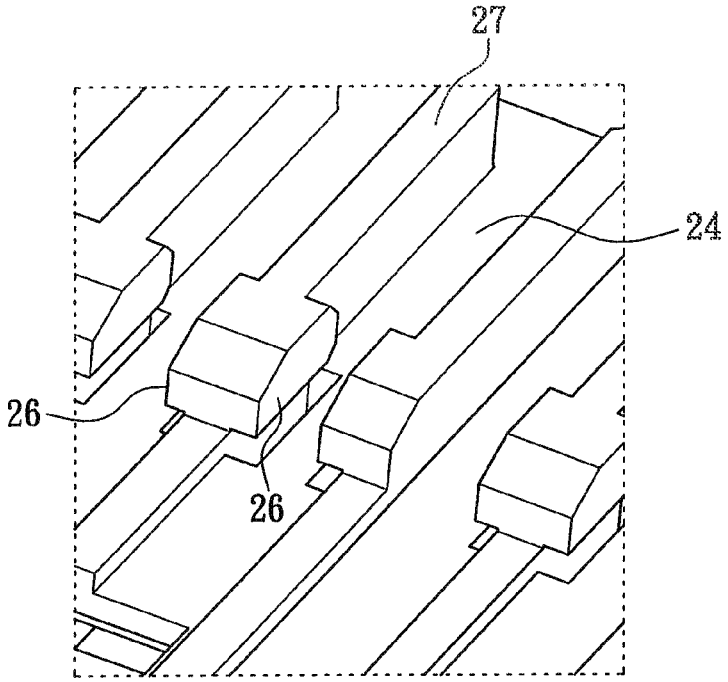
FIG. 6 is an enlarged view of part A of FIG. 5.
Figure 7:
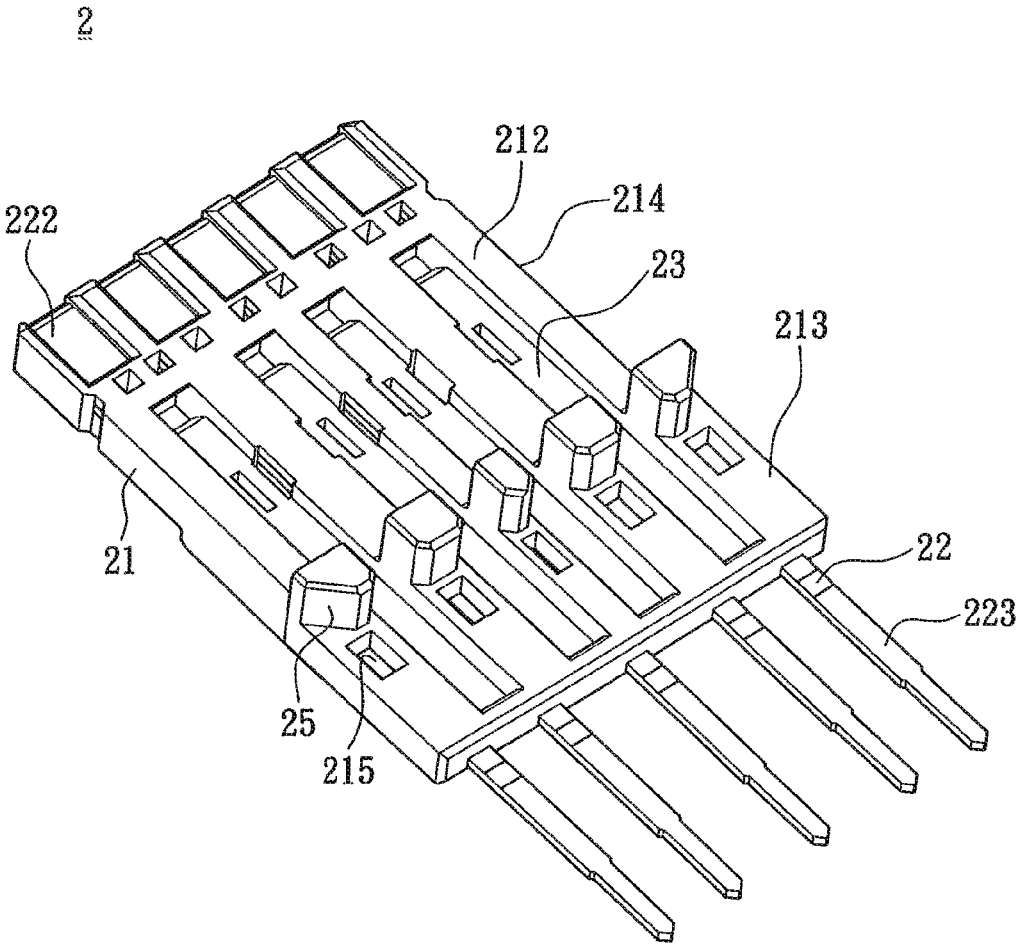
FIG. 7 illustrates another perspective view of the tongue module depicted in FIG. 5.
Figure 8:
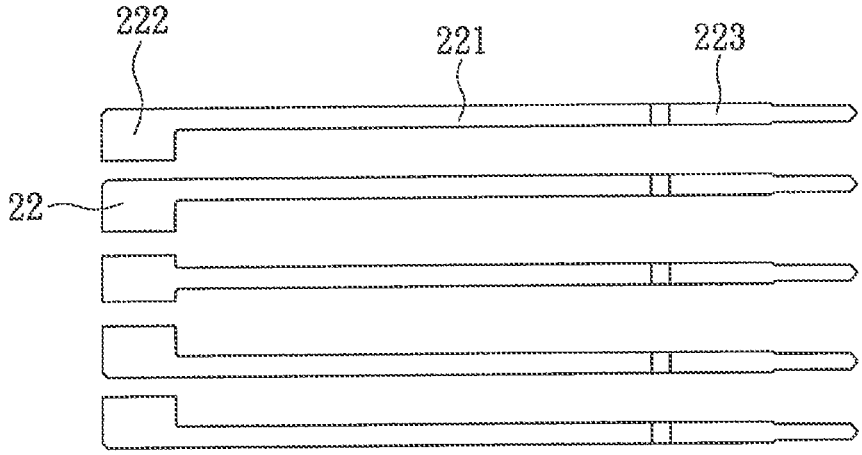
FIG. 8 illustrates a plan view of an embodiment of first terminals.
Figure 9:
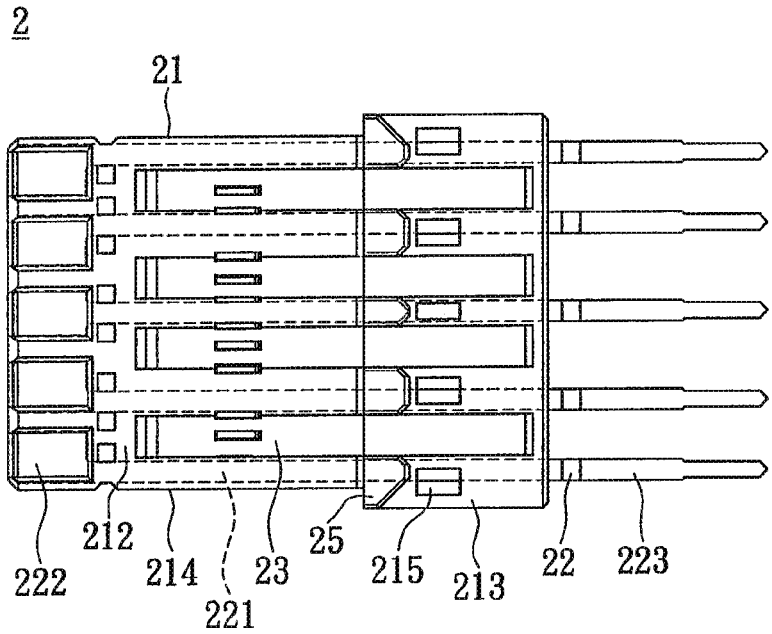
FIG. 9 illustrates a plan view of an embodiment of a tongue module.
Figure 10:
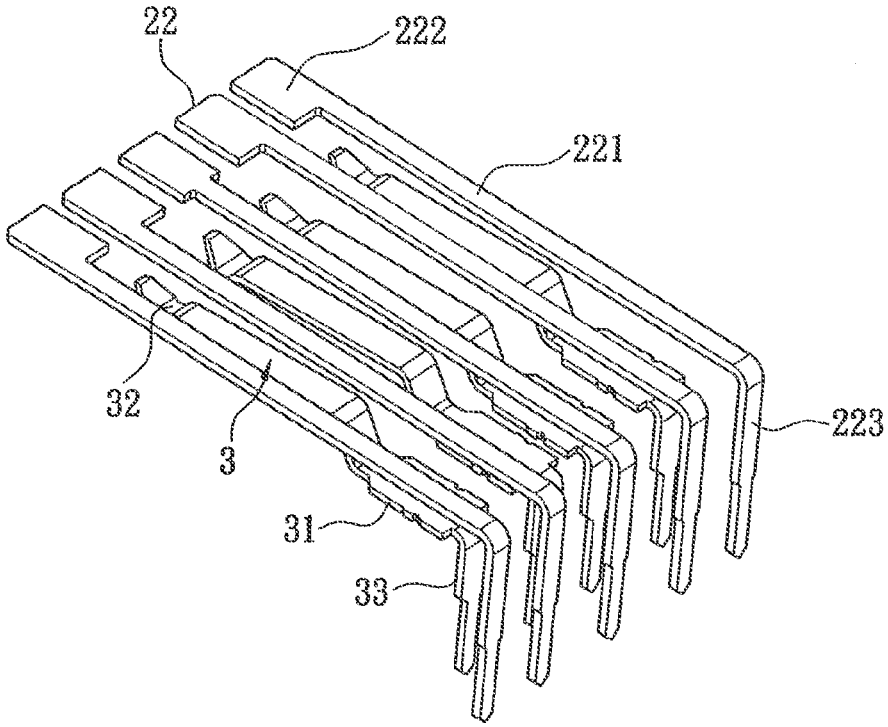
FIG. 10 illustrates a perspective simplified view of an embodiment of terminals suitable for use in a tongue module.
Figure 11:
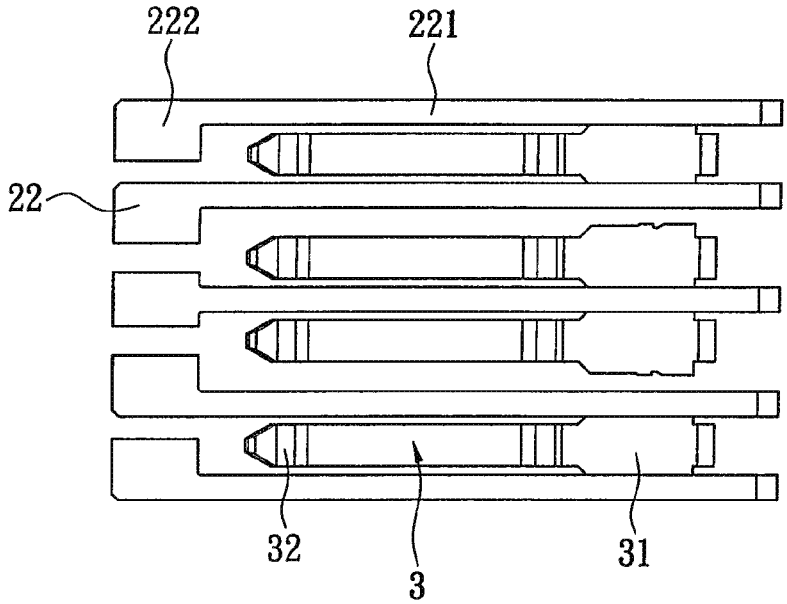
FIG. 11 illustrates an elevated top view of the terminals depicted in FIG. 10.
Figure 12:
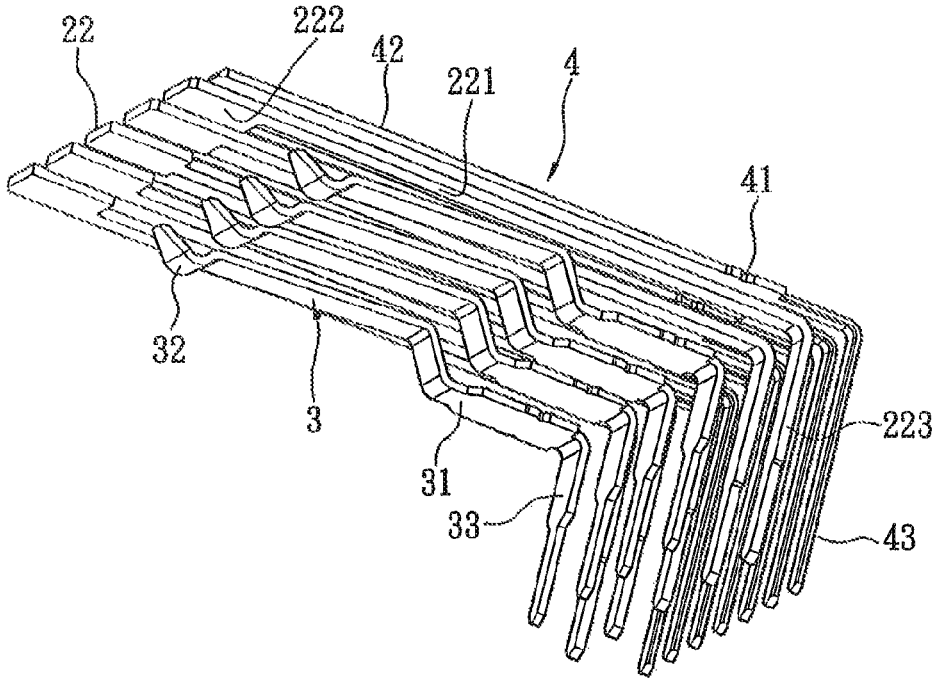
FIG. 12 illustrates a perspective view of an embodiment of first terminals, second terminals and third terminals.
Figure 13:
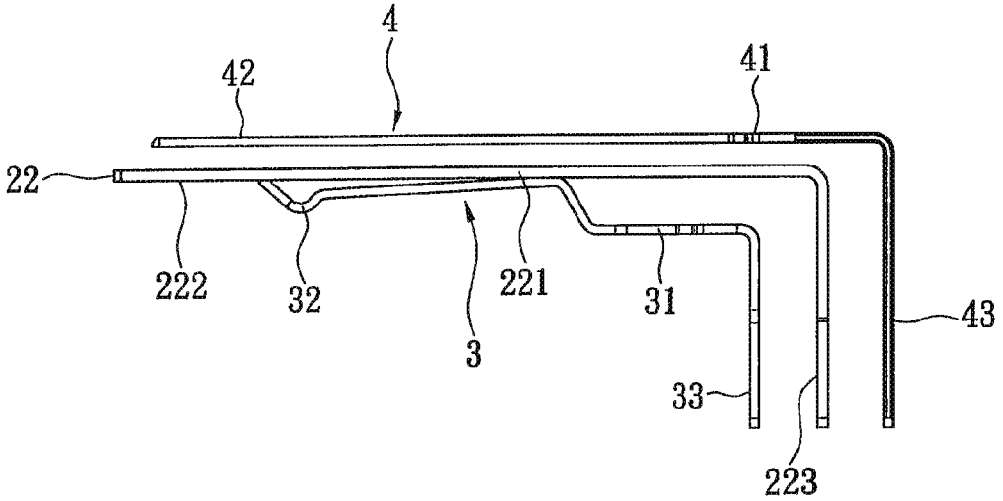
FIG. 13 illustrates an elevated side view of the embodiment depicted in FIG. 12.
Figure 14:
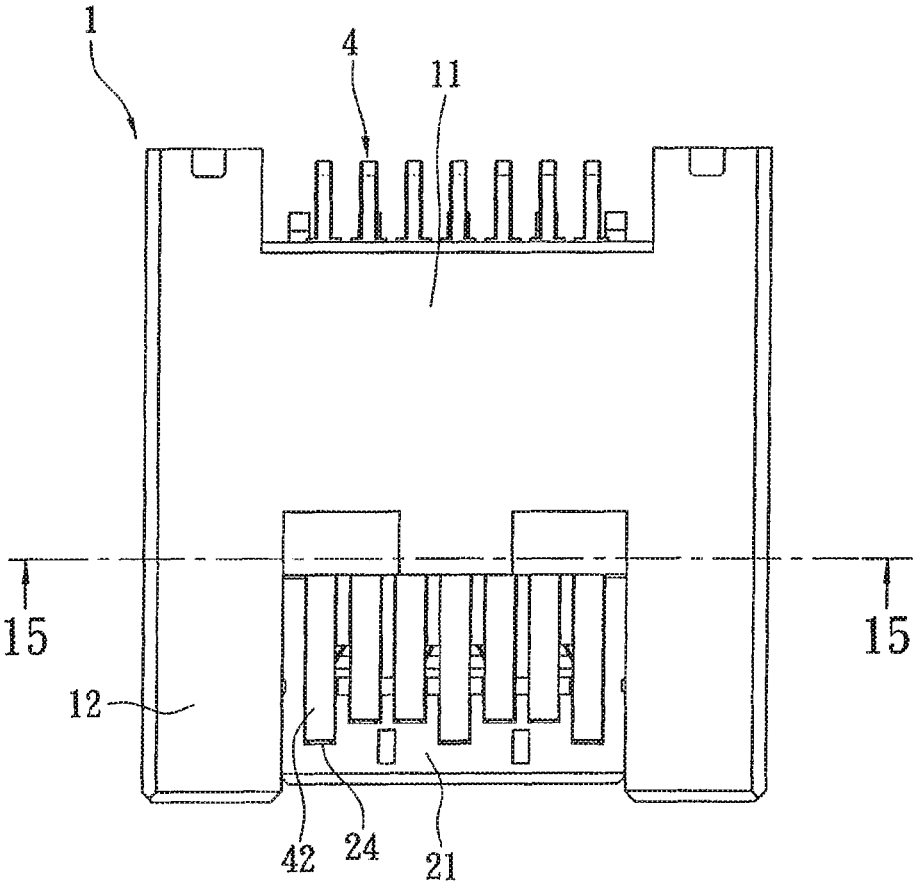
FIG. 14 illustrates a simplified plan view of an embodiment of a connector without a metal shell.
Figure 15:
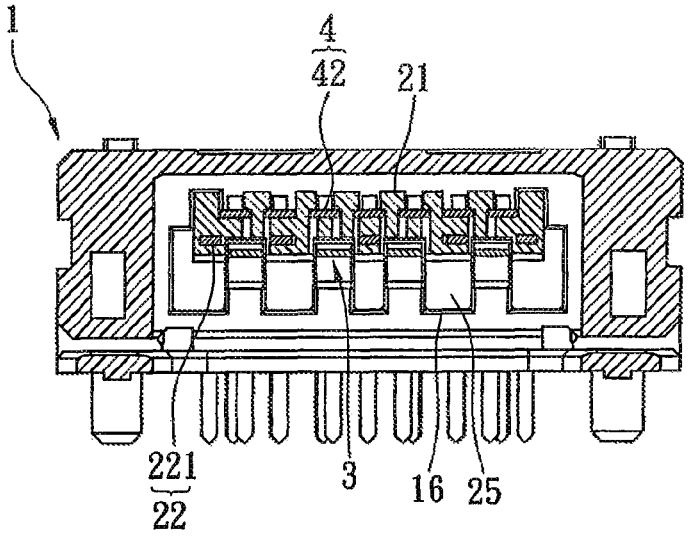
FIG. 15 illustrates a cross-sectional view of the embodiment depicted in FIG. 14 taken along line 15-15.
Figure 16:
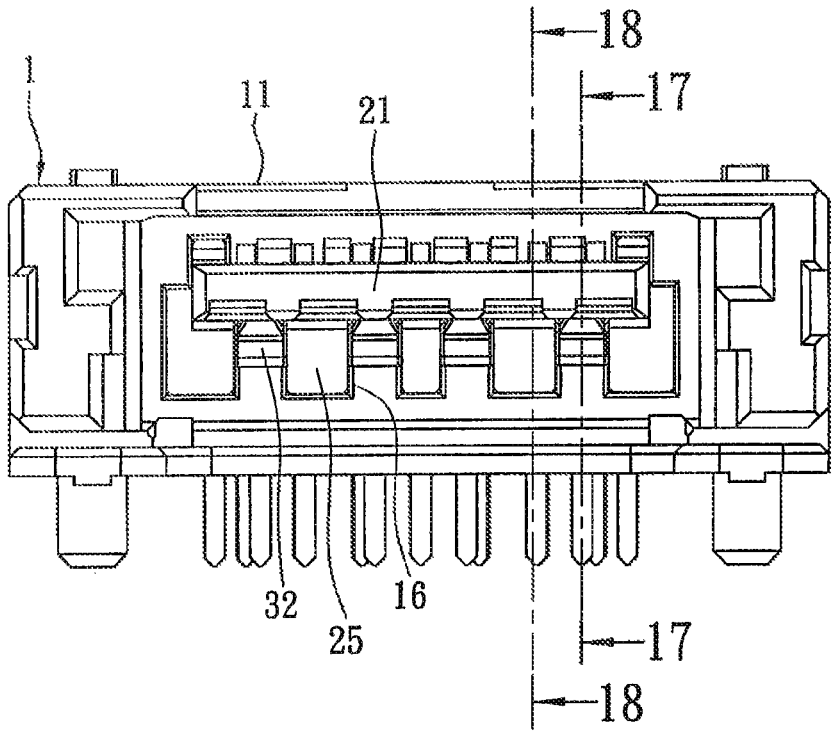
FIG. 16 illustrates an elevated front view of the embodiment depicted in FIG. 14.
Figure 17:
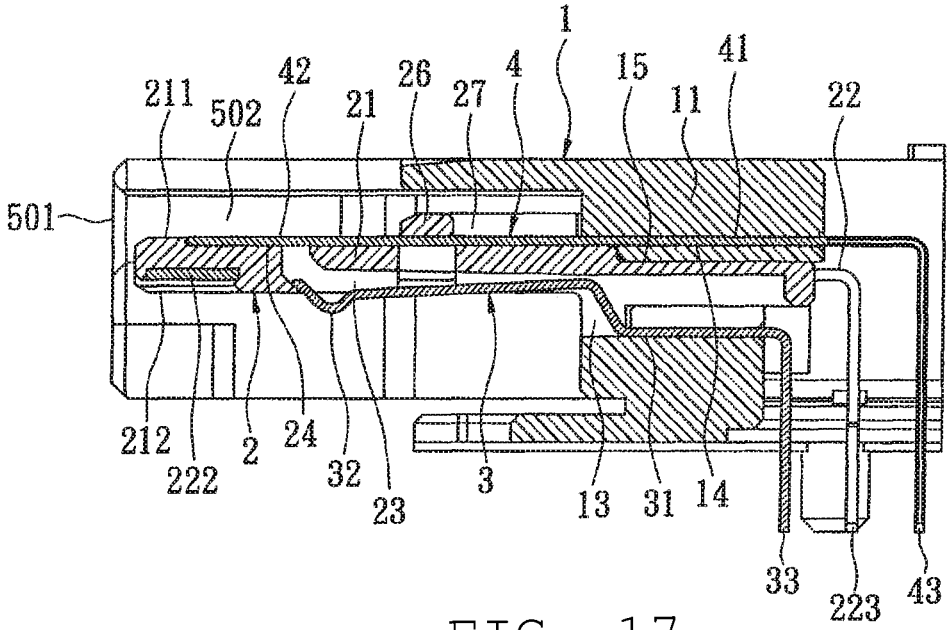
FIG. 17 illustrates a cross-sectional view of the embodiment depicted in FIG. 16 taken along the line 17-17.
Figure 18:
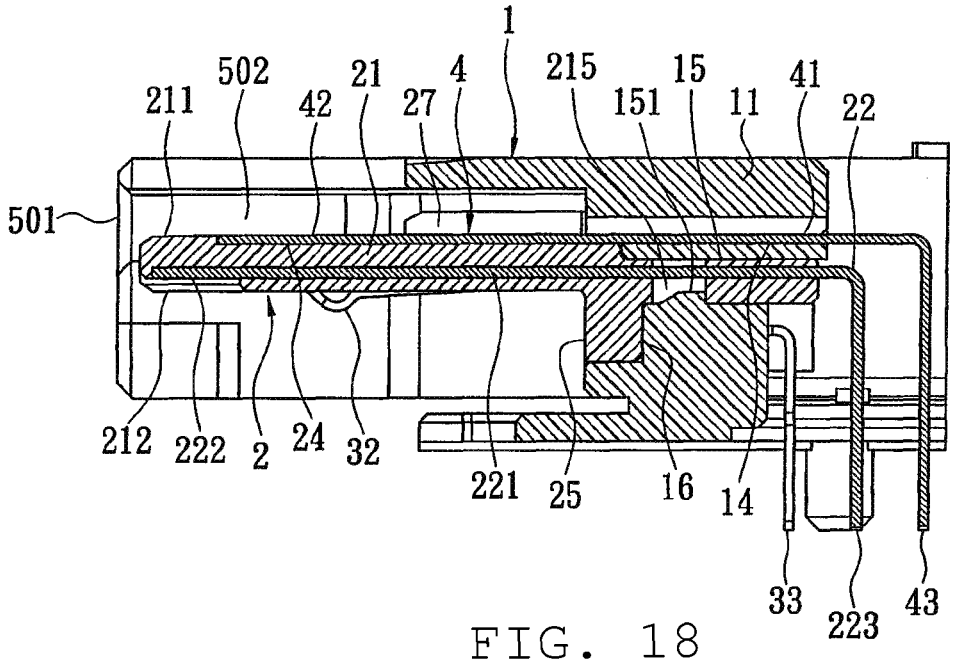
FIG. 18 illustrates a cross-sectional view of the embodiment depicted in FIG. 16 taken along the line 18-18.
Figure 19:
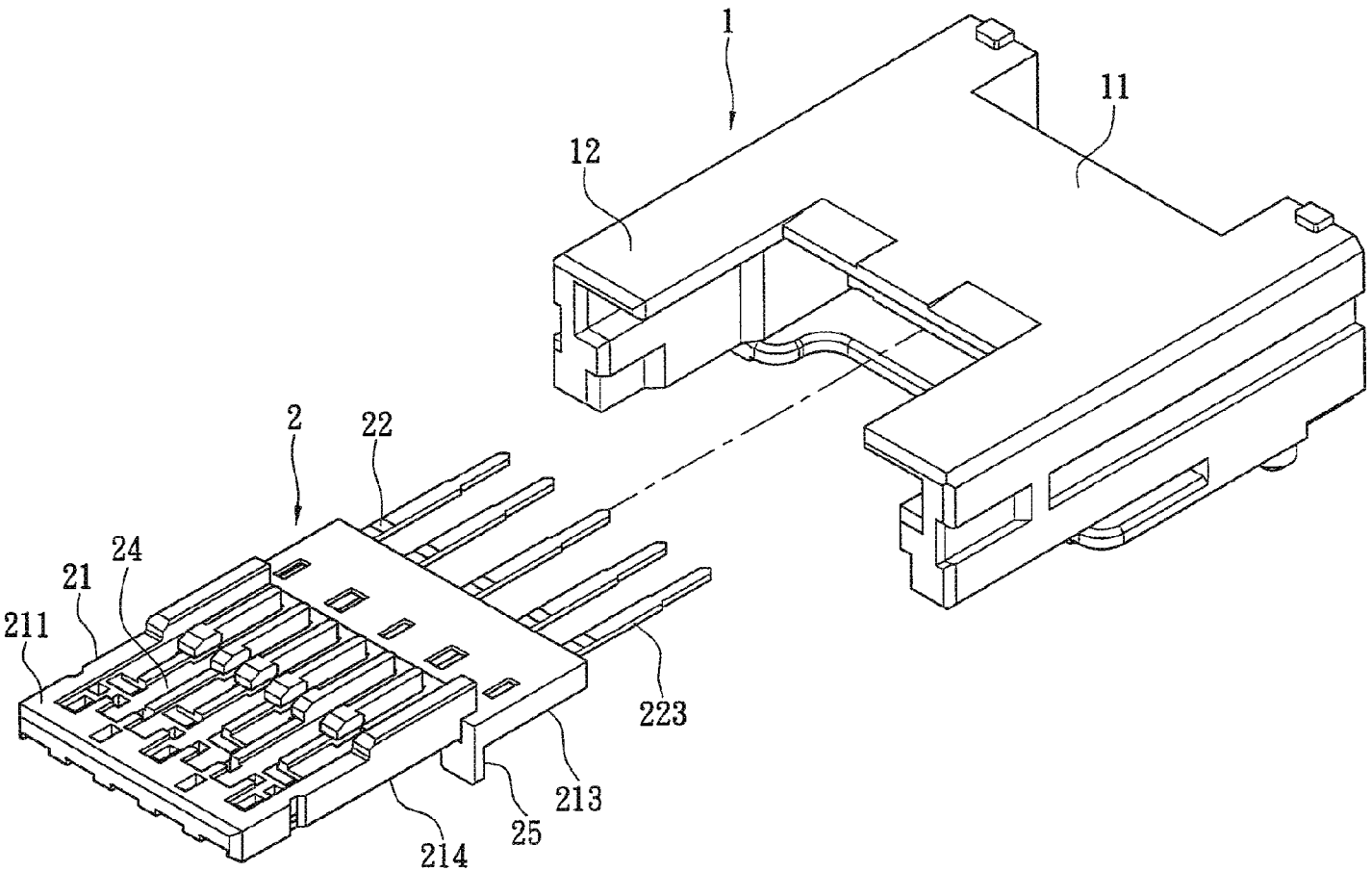
FIG. 19 illustrates a perspective view of a simplified, partially assembled connector.
Figure 20:
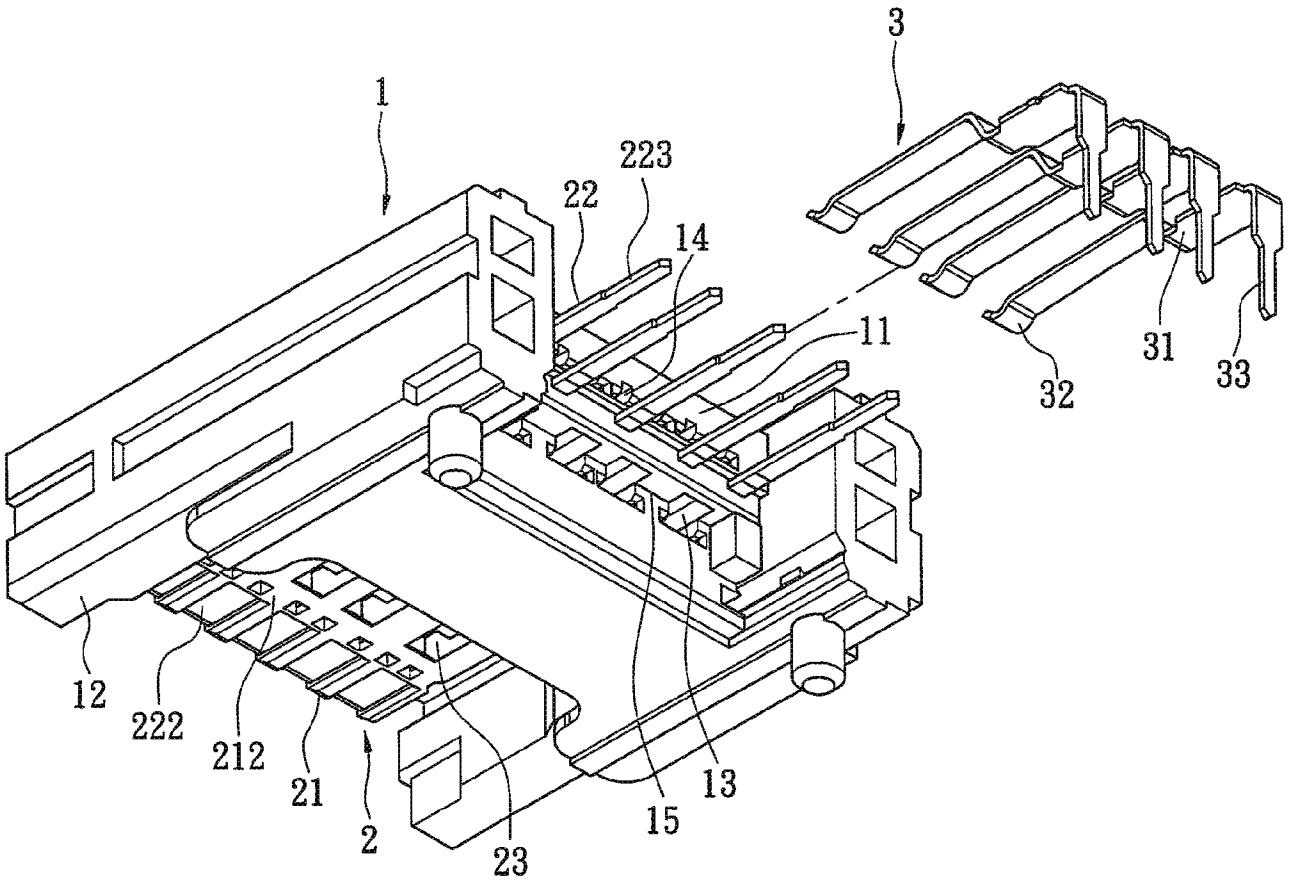
FIG. 20 illustrates a perspective view of the simplified, partially assembled connector of FIG. 19, showing an additional manufacturing step.
Figure 21:
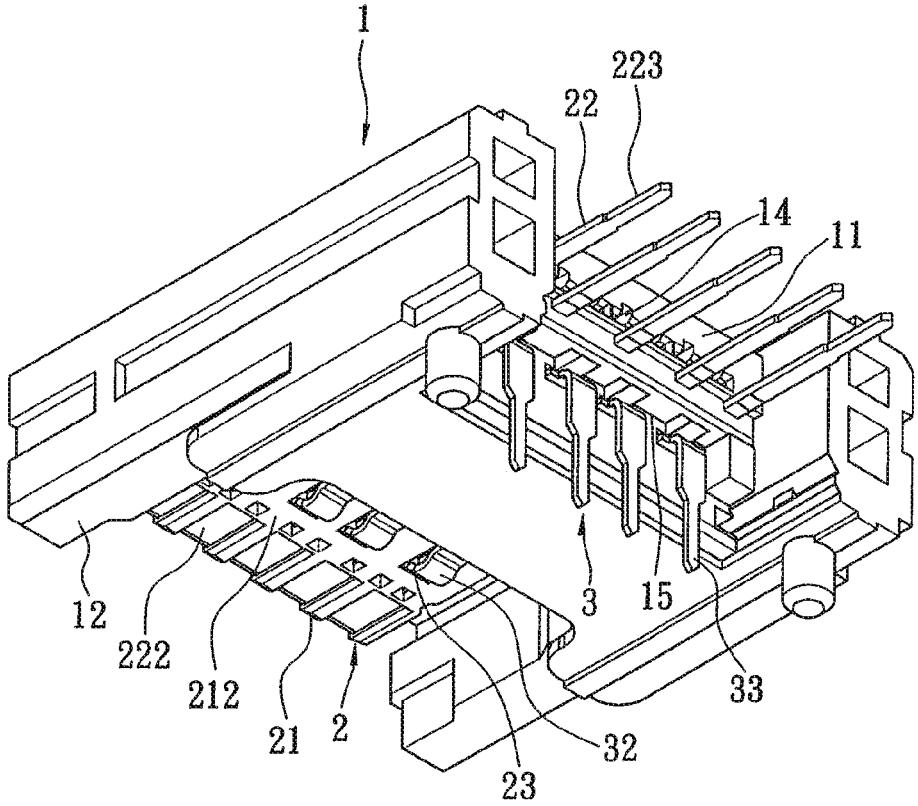
FIG. 21 illustrates a perspective view of the simplified, partially assembled connector of FIG. 20, showing an additional manufacturing step.
Figure 22:
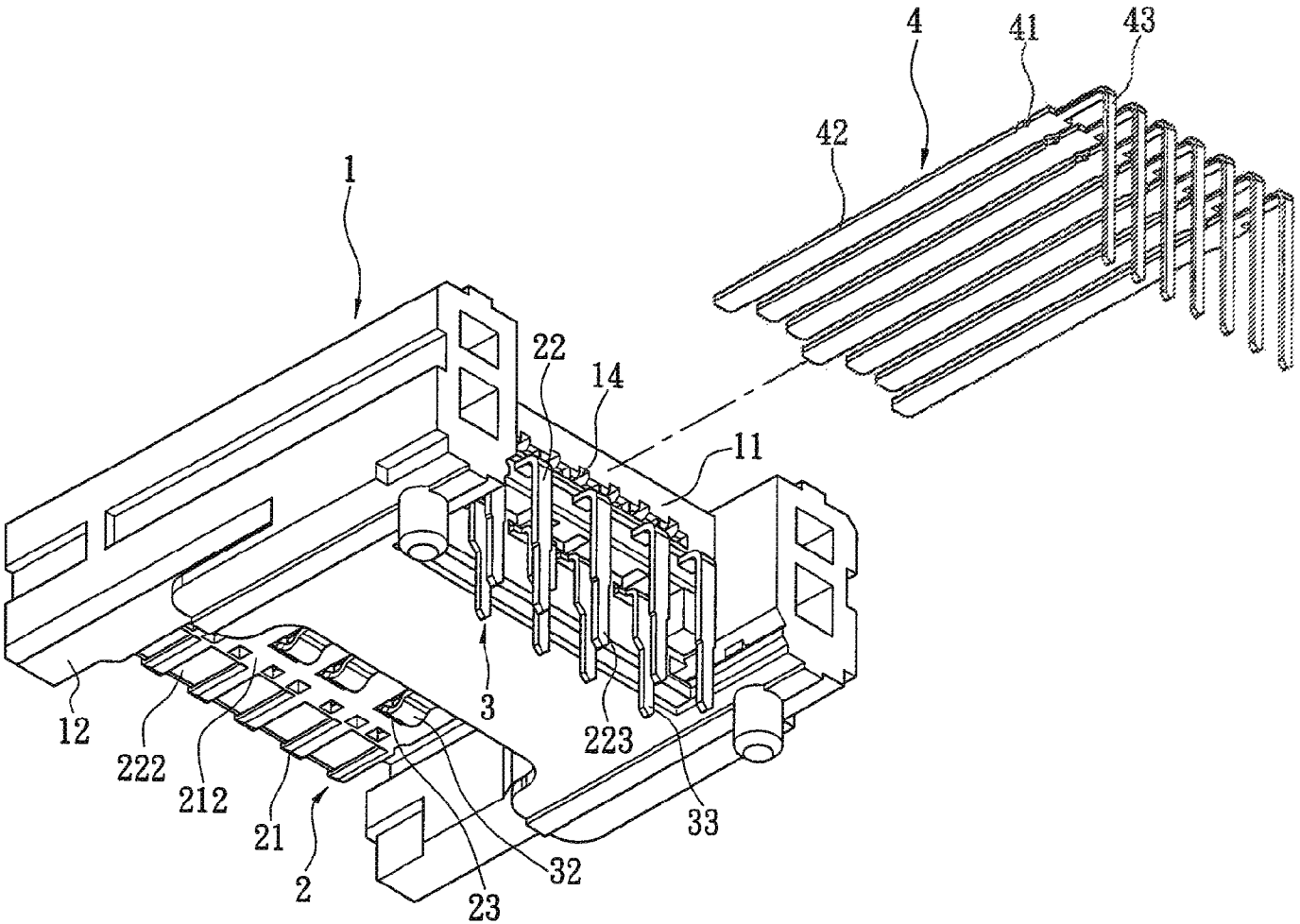
FIG. 22 illustrates a perspective view of the simplified, partially assembled connector of FIG. 20, showing an additional manufacturing step.
Figure 23:
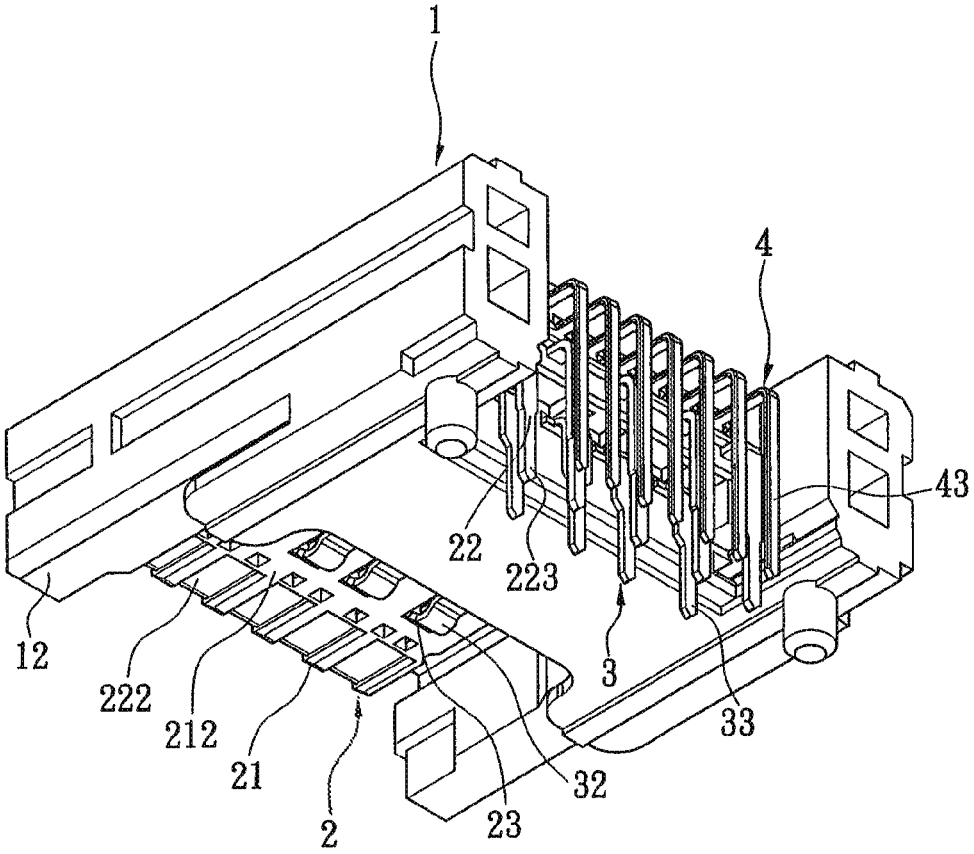
FIG. 23 illustrates a perspective view of the connector depicted in FIG. 22 with the terminals installed.
Figure 24:
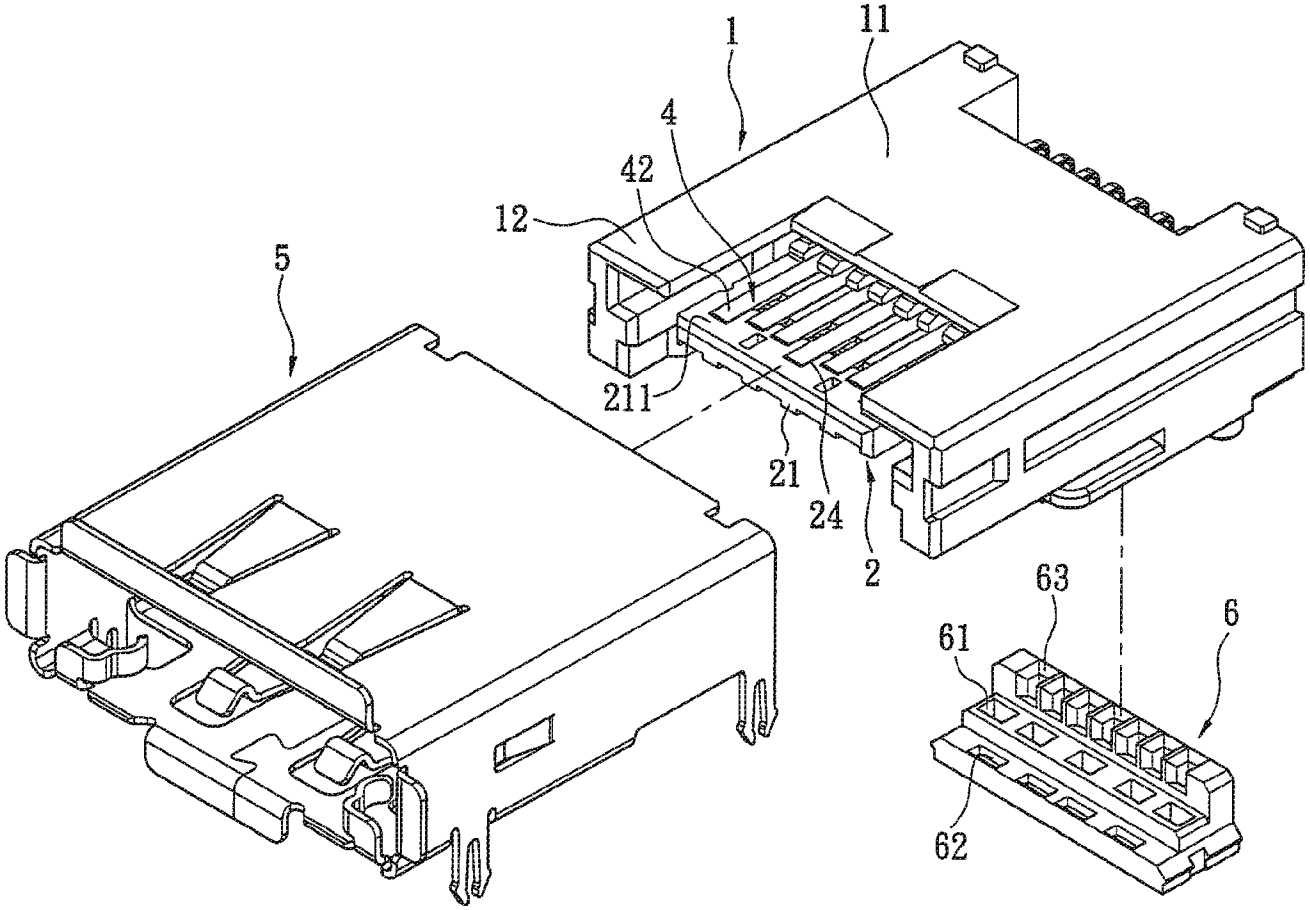
FIG. 24 illustrates an exploded perspective view of the connector depicted in FIG. 23 along with additional components configured to be joined together.
Figure 25:
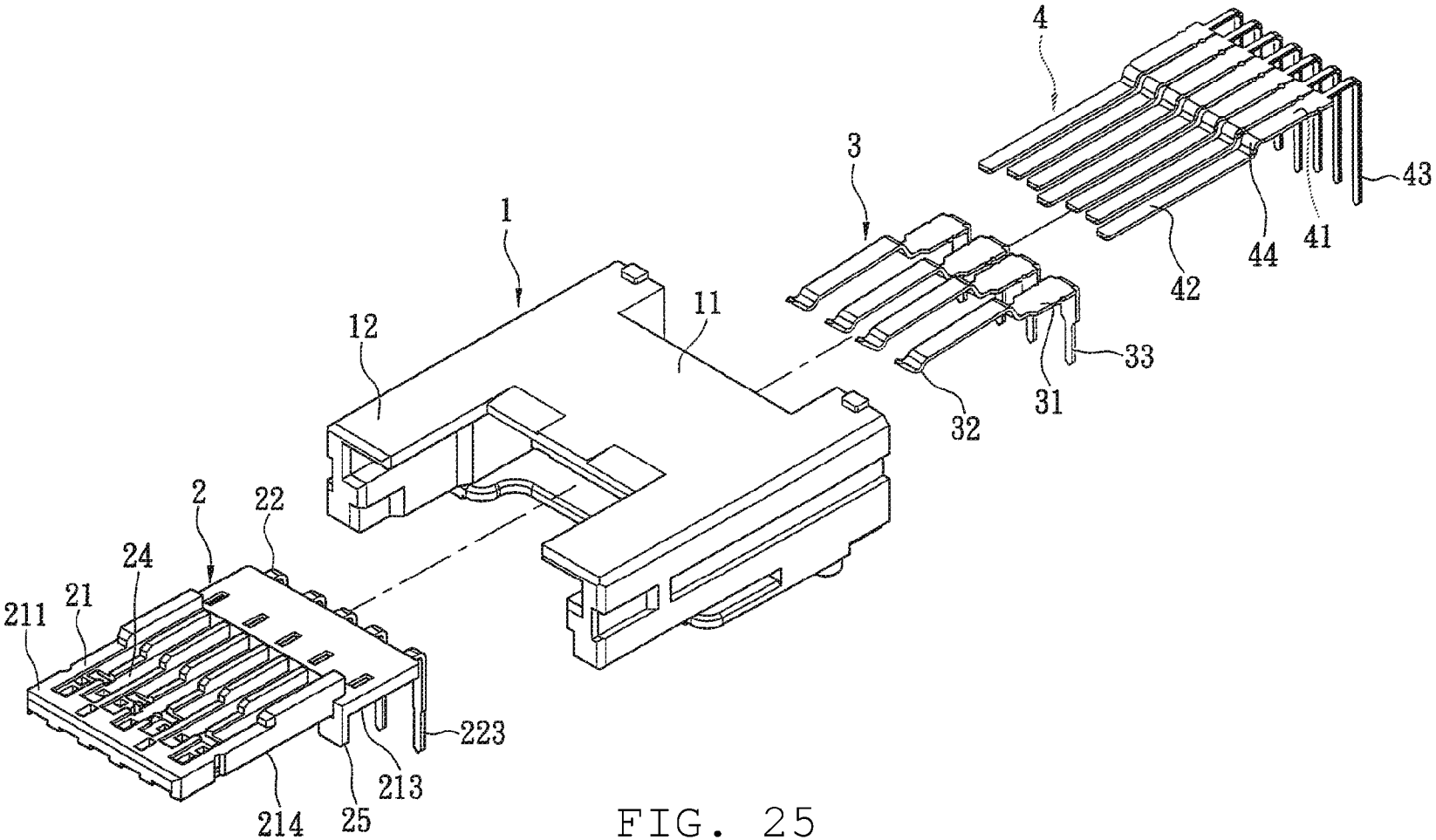
FIG. 25 illustrates an exploded perspective view of a second embodiment of an electrical connector.
Figure 26:
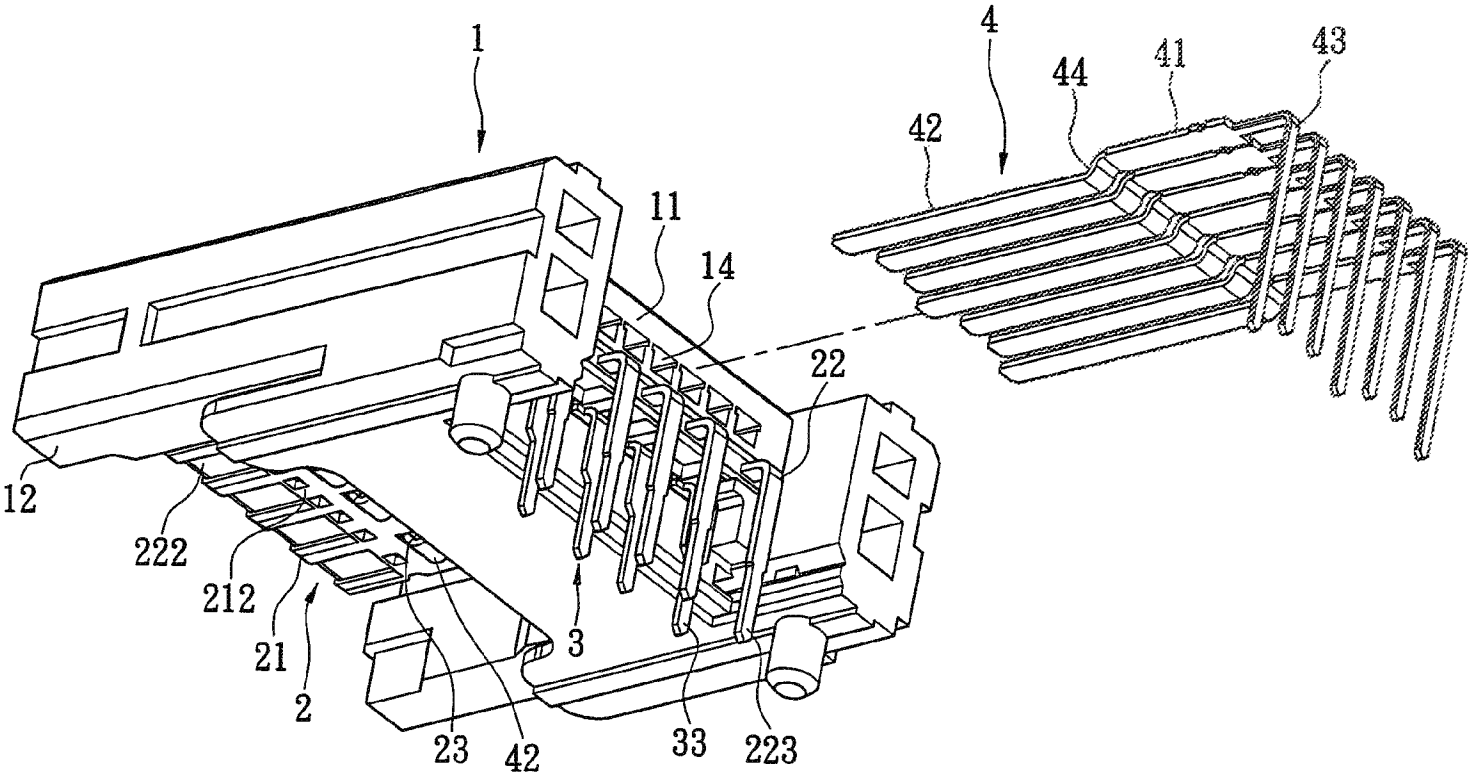
FIG. 26 illustrates a partially exploded perspective view of the embodiment depicted in FIG. 25 with third terminals not assembled.
Figure 27:
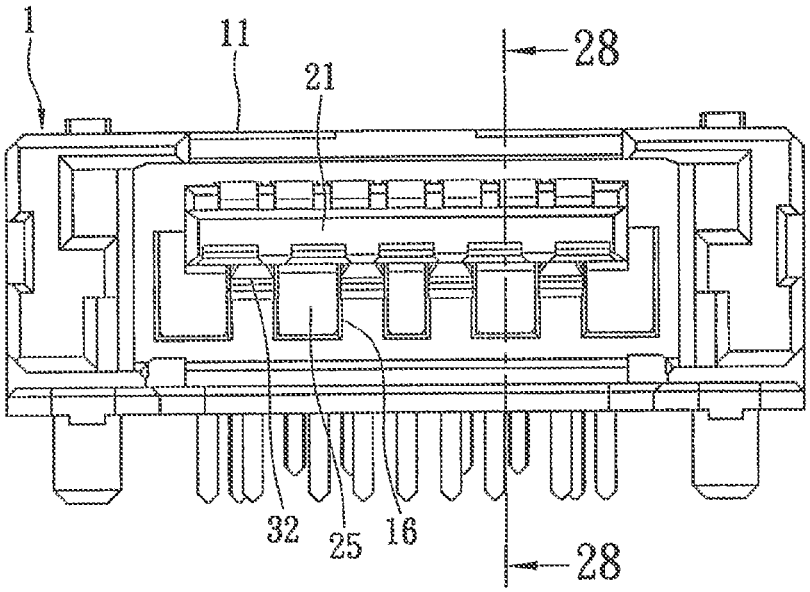
FIG. 27 illustrates an elevated simplified front view of the connector depicted in FIG. 25 without a metal shell.
Figure 28:
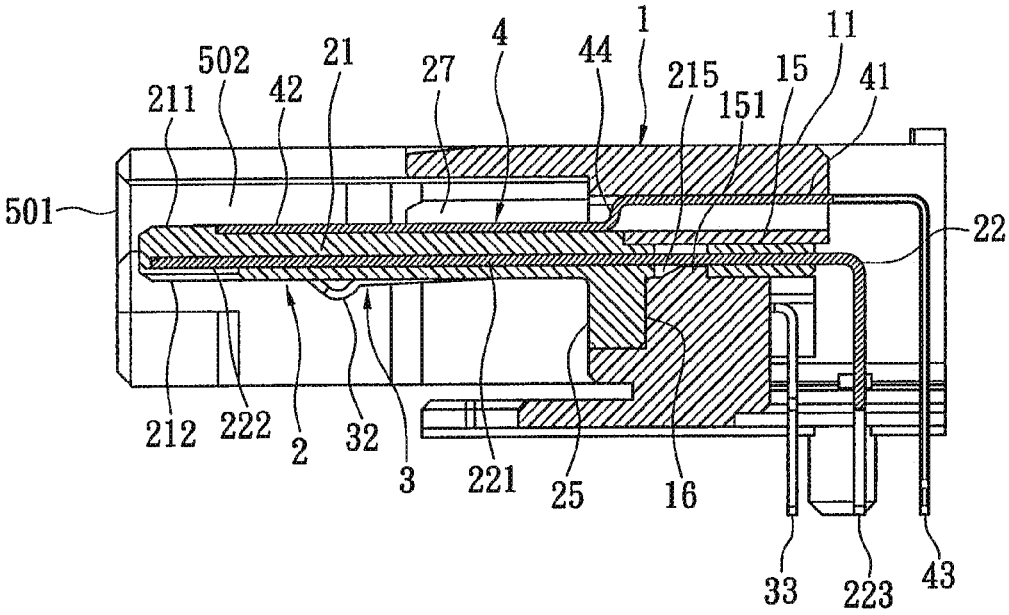
FIG. 28 illustrates a cross-sectional view of the embodiment depicted in FIG. 27 taken along line 28-28.
Figure 29:
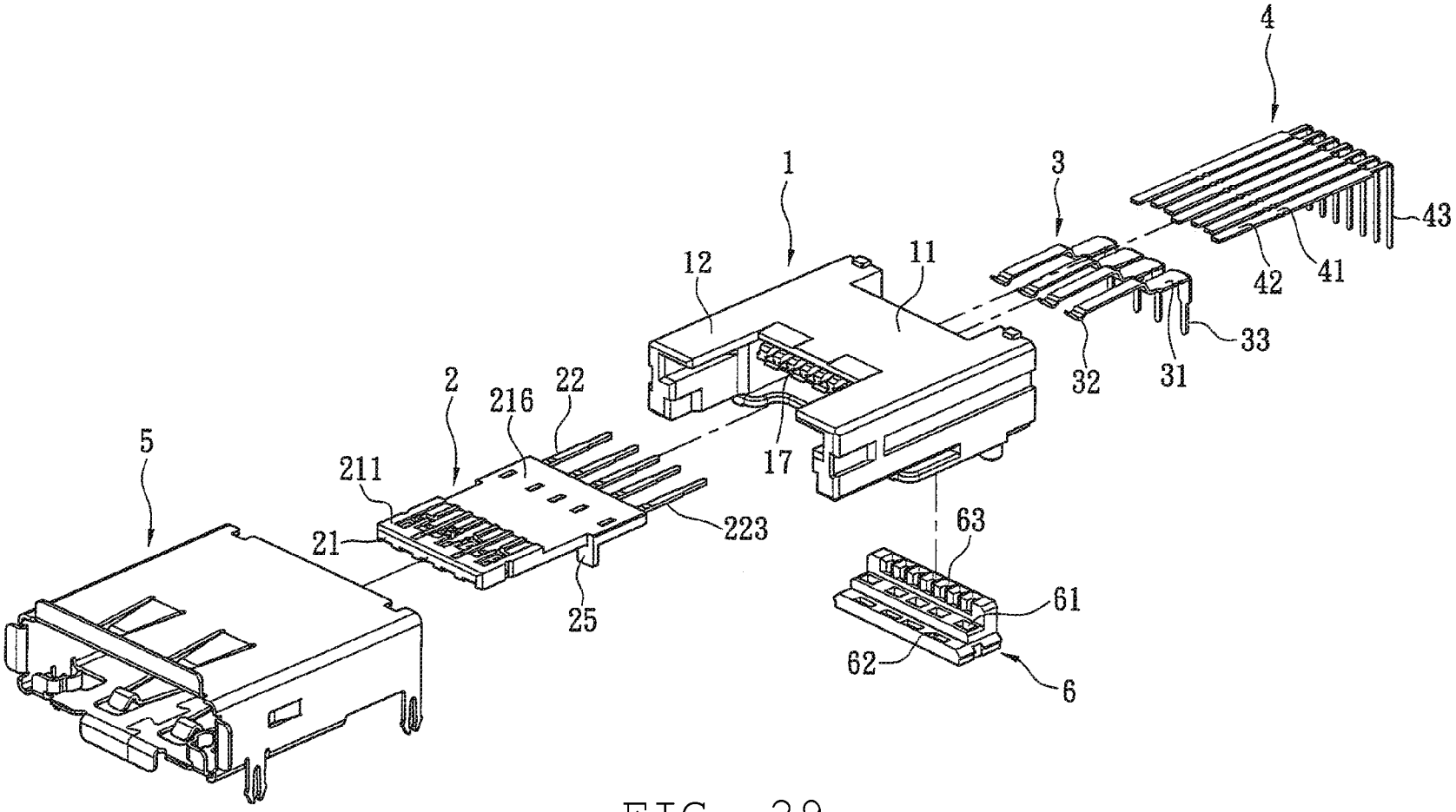
FIG. 29 illustrates an exploded perspective view of a third embodiment of an electrical connector.
Figure 30:
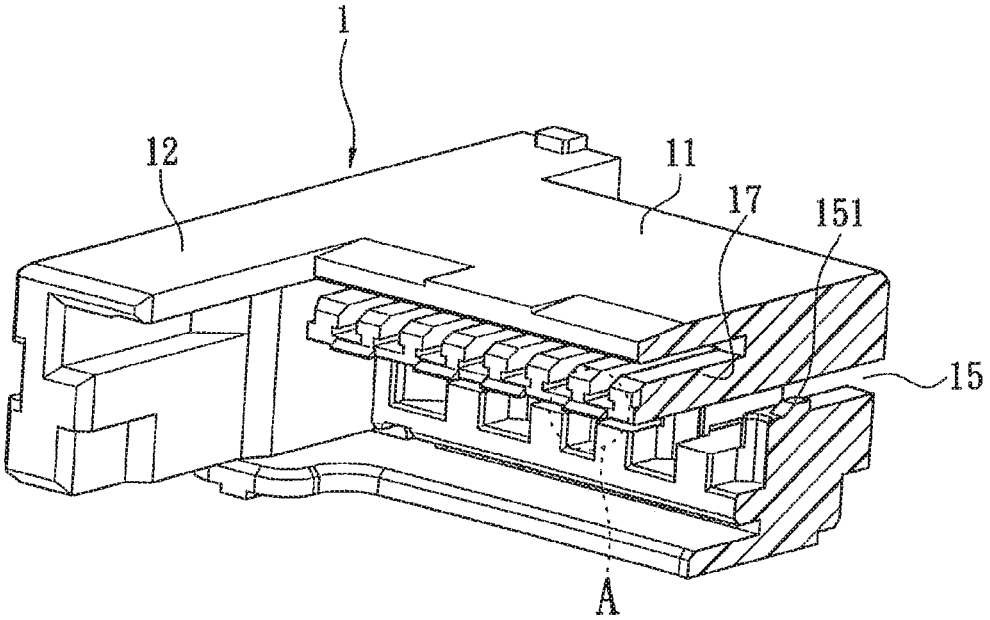
FIG. 30 illustrates a cross-sectional perspective view of an embodiment of an housing suitable for use with the embodiment depicted in FIG. 29.
Figure 31:
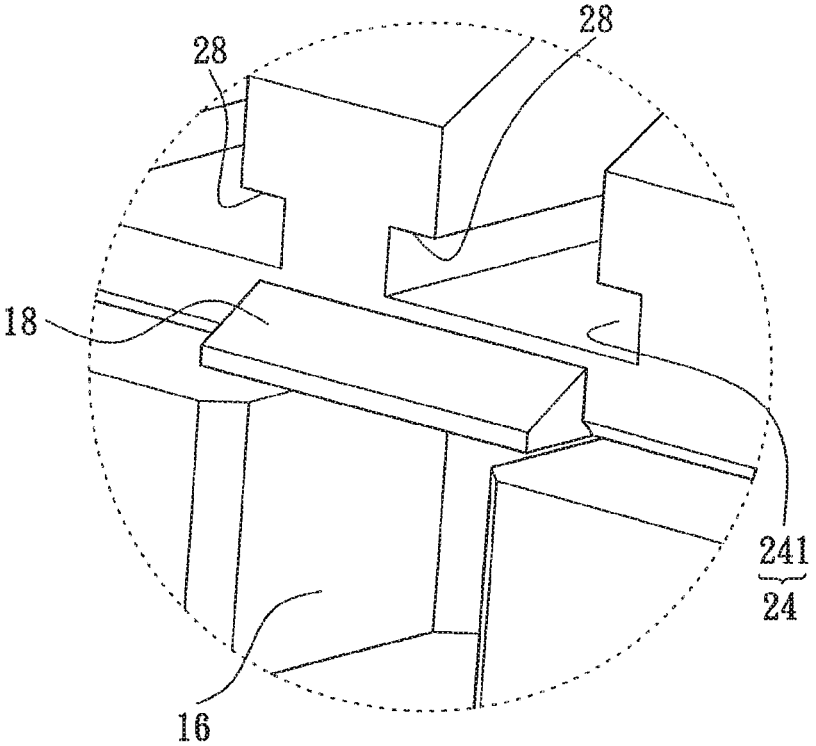
FIG. 31 illustrates an enlarged view of area A depicted in FIG. 30.
Figure 32:
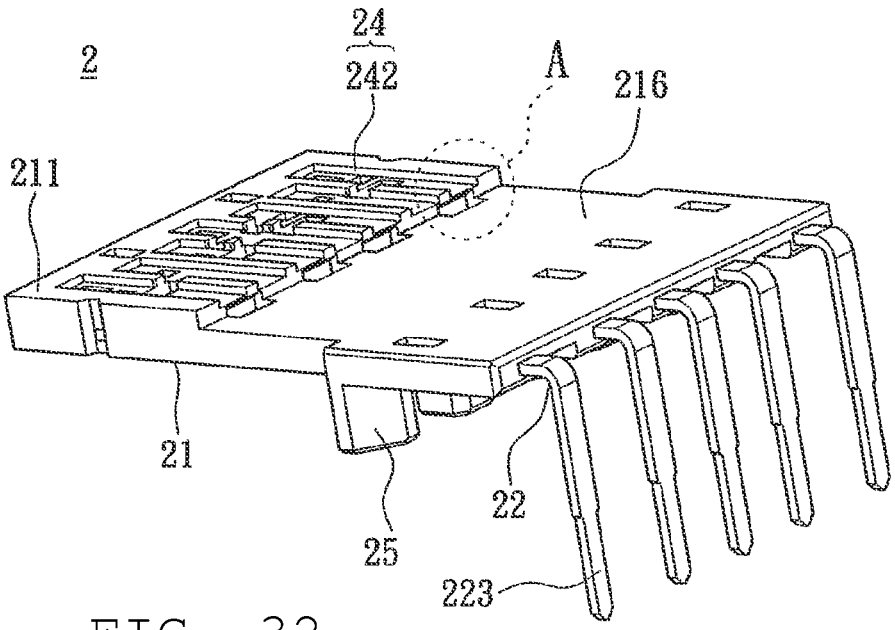
FIG. 32 illustrates a perspective view of an embodiment of a tongue module.
Figure 33:
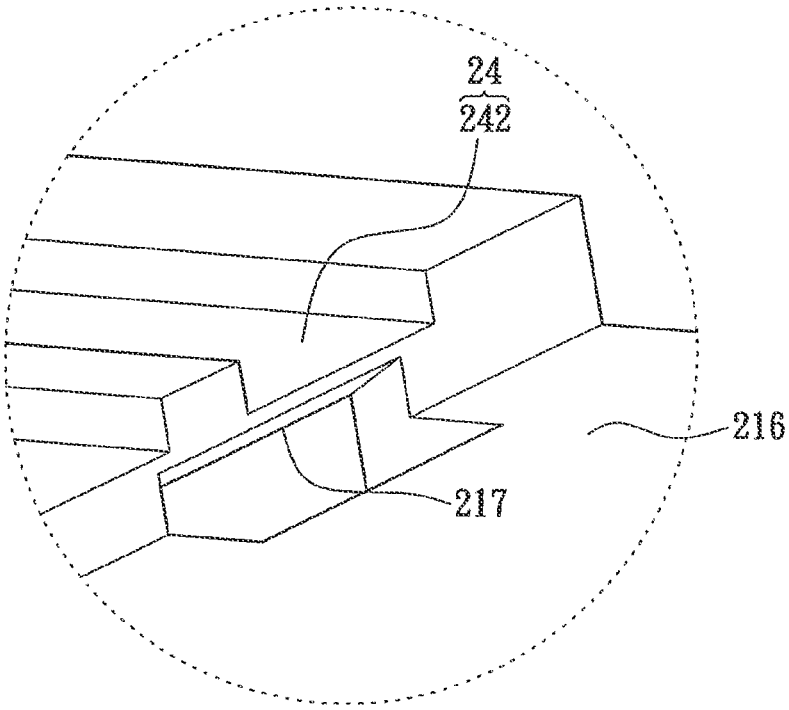
FIG. 33 illustrates an enlarged view of area A depicted in FIG. 32.
Figure 34:
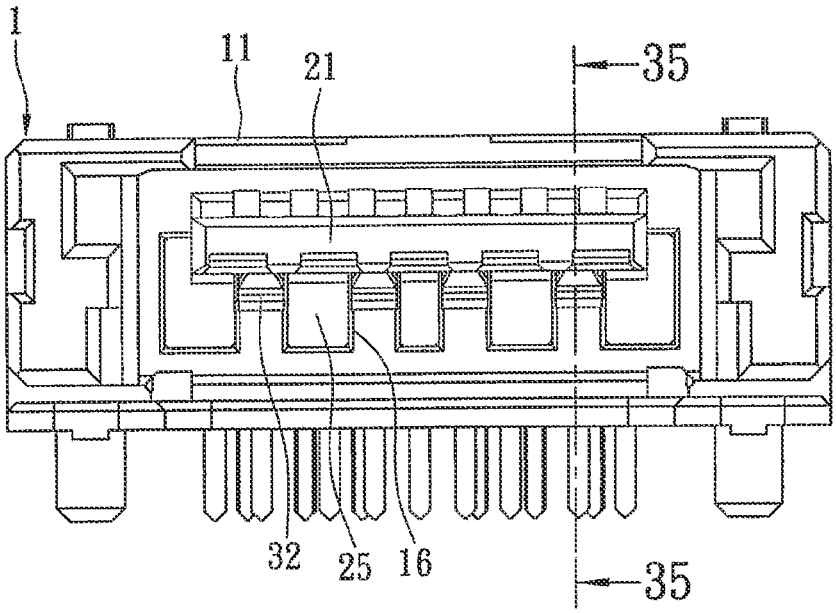
FIG. 34 illustrates an elevated front view of the embodiment depicted in FIG. 29 without a metal shell.
Figure 35:
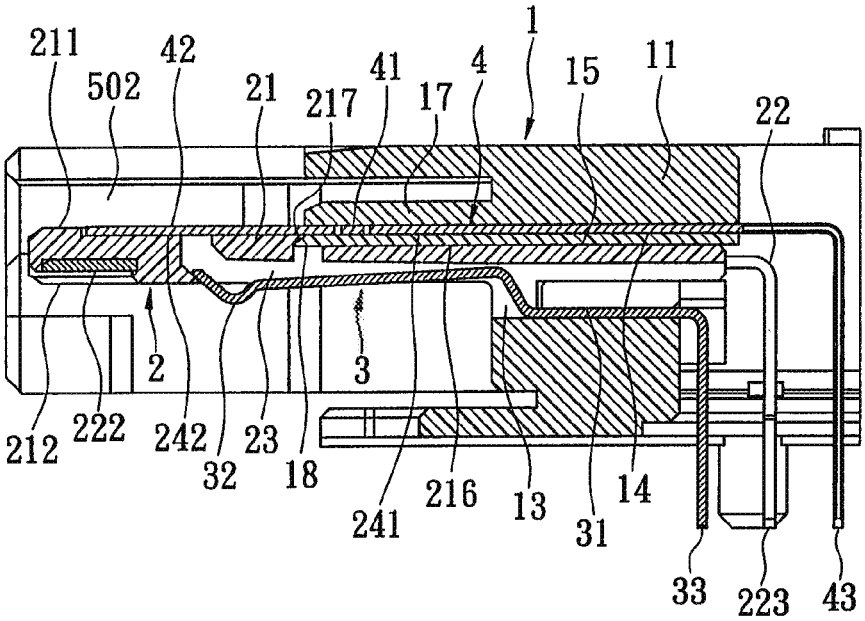
FIG. 35 illustrates a cross-sectional view of the embodiment depicted in FIG. 34 taken along line 35-35.

As can be appreciated from FIG. 3, each second terminal 3 has a second fixed part 31, a second contact portion 32 that extends from one end of second fixed part 31 and a second solder portion 33 that extends from the other end of the second fixed part 31. Each third terminal 4 has a third fixed part 41, a third contact portion 42 that extends from one end of the third fixed part 41 and a third solder portion 43 that extends from the other end of the fixed part 41.

As depicted, the number of the first terminals 22 is five. The number of the second terminals 3 is four. The number of the third terminals 4 is seven, wherein the first terminals 22 are used in conjunction with the second terminals 3 as the terminals to transmit USB 3.0 signals. The second terminals 3 can be used independently as the terminals to transmit USB 2.0 signals. The third terminal 4 are used as terminals for transmission of ESATA signals.

Metal shell 5 is assembled on housing 1, and the combination of housing 1 and metal shell 5 forms on its front end the plughole 501 and a plug in space 502 that extends inwardly from the plughole 501.

The tongue module 21 is assembled and affixed onto the housing 1 and is located inside the plug in space 502. The solder portions 223 of the first terminals 22 extend out of the housing 1. As can be appreciated, the depicted composition of tongue module 21 has an assembly part 213 and a tongue 214 that extends from the assembly part 213 in the direction of the plughole 501. The assembly part 213 is assembled and affixed onto assembly slot 15 of the housing 1, and the tongue 214 extends into the plug in space 502. The third terminal receiving slots 24 are located on the tongue 214.

The second terminals 3 are correspondingly installed in second terminal paths 13 of the housing 1 and extend to second terminal receiving slots 23 of the tongue module 21. The second fixed parts 31 of the second terminal 3 interfere with second terminal paths 13 affixed onto housing 1. The second contact portions 32 are exposed on the lower surface 212 of the tongue module 21. The second solder portions 33 extend out of housing 1 and are located in the front of the first solder portions 223.

The third terminals 4 are correspondingly installed in third terminal paths 14 of housing 1 and extend to third terminal receiving slots 24 of tongue module 21. The third fixed parts 41 of the third terminals 4 interfere with third terminal paths 14 affixed inside base 11 of housing 1. The third contact portions 42 are exposed on upper surface 211 of tongue module 21. The third solder portions 43 extend out of housing 1 and are located in the rear part of the first solder portions under second terminal receiving slots 23. Since holding blocks 26 are placed beside third terminal receiving slots 24 to hold down third contact portions 42 of third terminals 4, the terminals 4 can be securely positioned and the warping and buckling of third terminals 4 can be prevented; the electric connector can be formed through the aforementioned composition.

Since the pitch between first extended parts 221 of two adjacent first terminals 22 is greater than the width of second terminal receiving slots 23, the positions of the first terminals 2 and the second terminals 3 can get closer in the thickness direction of the tongue module 21 and be overlapping spatially and can be staggered in the width direction of the surface of the tongue module 21, so that the occurrence of interference can be avoided during the assembly of second and third terminals 3 and 4. This allows helps provide sufficient spatial deformation and shift for the second terminals 3.

Assembly part 213 of tongue module 21 has a plurality of first fixed parts 215. Housing 1 has a plurality of second fixed parts 151 in the assembly slot 15. The second fixed parts 151 and the first fixed parts 215 fit and are affixed onto each other. In the present embodiment, first fixed parts 115 are clamp holes formed by an inner concave on lower surface 212 of tongue module 21. Second fixed parts 151 are clamp blocks that protrude out of the inner bottom surfaces of assembly slot 15. The clamp blocks and clamp buckles fit in the clamp holes, thus affixing assembly parts 213 of tongue module 21 in assembly slot 15 of housing 1.

The tongue module 21 separately extends downward into a plurality of positioning support blocks 25. The housing 1 has a plurality of positioning receiving slots 16. The positioning support blocks 25 are correspondingly accommodated in the positions and receiving slots 16, just providing the tongue module 21 with a steady supporting force and thus being capable of bearing a large torque action.

It should be noted that except for the first terminal 22 located in the center, of the aforementioned five first terminals 22, the remaining first terminals 22 are separately arranged, in pairs of two, on the two opposite sides of first terminal 22 located in the center, and their shape has a mirror relationship relative to first terminal 22 located in the center. The first extended parts 221 of paired first terminals 22 are placed eccentrically to the center of first contact paths 222 and the opposite outer side. The paired first terminals 22 are used to transmit paired signals. In the present embodiment, the length from the first contact portions 222 of the first two paired terminals 22 to first solder portions 223 is the same, so that the transmittal paths of the signals are equidistance, thus helping to prevent signal deflection and distortion.

The electric connector further comprises a positioning part 6 made of insulating materials. Positioning part 6 forms a plurality of positioning holes 62, 61 and 63 that traverse its upper surface and lower surface from the front to the rear. The positioning part 60 is assembled on the rear end of housing 1 from the bottom to the top, and first solder portions 223 of the first terminals 22, second solder portions 33 of second terminals 3 and third solder portions 43 of third terminals are correspondingly plugged into positioning holes 61, 62 and 63, to achieve the effect of positioning and preventing them from contacting each other.

Next, with reference to FIGS. 19 to 24, an assembly method may comprise a number of steps. It should be noted, however, that other assembly methods could also be used if desired. An housing 1 is provided. The housing 1 includes a plurality of second terminal paths 13 and a plurality of third terminal paths 14.

In addition, a tongue module 21 is provided. A plurality of first terminals 22 are disposed in tongue module 21 and they may be so positioned by an insert molding process. First solder portions 223 of the first terminals 22 horizontally extend out of the tongue module 21. Lower surface 212 of the tongue module 21 has a plurality of second terminal receiving slots 23, whereas upper surface 211 of the tongue module 21 has a plurality of third terminal receiving slots 24, wherein the second terminal receiving slots 23 are located between the first terminals 22 and the pitch between the first extended parts to 221 of the two adjacent first terminals 22 is greater than the width of the second terminal receiving slots 23.

The tongue module 21 can be assembled onto the housing 1. Then a plurality of second terminals 3 can be installed in second terminal paths 13 of the housing 1 and so that they extend to second terminal receiving slots 23 on lower surface 212 of the tongue module 21, and second contact portions 32 of the second terminals 31 are exposed on lower surface 212 of the tongue module 21. Second solder portions 33 of the second terminals 3 extend out of the housing 1.

The first solder portions 223 of the first terminals 22 can then be bent to allow first solder portions two 123 of the first terminals 22 to extend out of the housing 1 and to be located in the rear of the second solder portions 33. Then a plurality of third terminals 4 can be installed in third terminal paths 14 of the housing 1 so that they extend to third terminal receiving slots 24 on lower surface 211 of the tongue module 21, and third contact portions 42 of the third terminals 4 are exposed on lower surface 211 of the tongue module 21. Third solder portions 43 of the third terminals 4 extend out of the housing 1 and are located in the rear of the first solder portions 223.

A positioning part 6 can then be provided. Positioning part 6 has a plurality of positioning holes 61, 62 and 63. The positioning part 6 is assembled on the rear end of the housing 1 from the bottom toward the top, and first solder portions 223 of the first terminals 22, second solder portions 33 of the second terminals 3 and third solder portions 43 of the third terminals 4 are correspondingly plugged into the positioning holes 61, 62 and 63. Then a metal shell 52 can be assembled to an exterior of the housing 1.

Referring next to FIG. 25 to FIG. 28, a second embodiment of the electric connector is depicted. Each third terminal 4 further comprises a bent part 44 that is placed between third fixed part 41 and third contact portion 42 and that is bent and extends downward, to allow the third contact portion 42 to be in a position lower than the position of third fixed part 41.

Referring to FIGS. 29 through 35, features suitable for use with a third embodiment of an electric connector are depicted. As can be appreciated, tongue module 21 further comprises a half extended board 17, which is formed by protruding and extending from base 11 of the housing 1 in the direction of plughole 501. Upper surface 211 of tongue module 21 is sunken inward in a position corresponding to the half extended board 17, to form a sunken area 216. The front end of half extended board 17 extends into a plurality of wedge shaped blocks 18 in the direction of plughole 501, and tongue module 21 forms a plurality of wedge shaped holes 217 in positions corresponding to the wedge shaped blocks 18. Third terminal receiving slots 24 in the present embodiment are jointly formed by first part 241 and second part 242, wherein first part 241 is located on the half extended board 17 and is connected to the third terminal paths 14, whereas second part 242 is located on upper surface 211 of tongue module 21.

During assembly, half extended board 17 of housing 1 is accommodated in sunken area 216 of tongue module 21 and the wedge shaped blocks 18 fit and are plugged into the wedge shaped holes 217, thus providing a supporting action for the tongue module 2. Third fixed part 41 of third terminals 4 interferes with and is affixed onto first part two for one of third terminal receiving slots 24.

In addition, beside each third terminal receiving slot 24, upper surface 211 of the tongue module 21 has a holding block 28 that extends to the upper part of first part 241 of third terminal receiving slot 24 and that is used to hold down third terminal 4 (please cooperate by referring to FIG. 31), which may similarly achieve the effect of positioning third terminal 4 and preventing it from warping and buckling.

As can be appreciated, an electric connector can dispose a plurality of first terminals that are insert molded in a tongue module. The pitch between the two adjacent first terminals is greater than the width of the second terminal receiving slots, so that the positions of the first terminals and the second terminals can get closer in the vertical or first direction of the tongue module and can be overlapping and can be staggered in the width direction of the surface of the tongue module, which allows for spatial deformation and shift of the second terminals. Therefore, during the assembly of the second and third terminals, the occurrence of interference can be avoided, while at the same time increasing the spacing between the first terminals and the third terminals in the thickness direction of the tongue module. In addition, the assembly method disclosed allows certain electric connectors to be easily manufactured and assembled.

The disclosure provided herein describes features in terms of preferred and exemplary embodiments thereof. Numerous other embodiments, modifications and variations within the scope and spirit of the appended claims will occur to persons of ordinary skill in the art from a review of this disclosure.

I claim:

1. An electric connector, comprising:

an housing including a plurality of second terminal paths and third terminal paths;

a tongue module, including a plurality of first terminals integrally disposed in the tongue module, each the first terminal having an extended part enclosed in the tongue module, a first contact portion that extends from one end of the first extended part and that is exposed from the front end of the lower part of the tongue module and a first solder portion that extends from the other end of first extended part and that extends out of tongue module, the tongue module further including a plurality of second terminal receiving slots on a lower surface and a plurality of third terminal receiving slots are placed on an upper surface of the tongue module;

a plurality of second terminals positioned in the second terminal paths, each of the second terminals having a second contact portion and a second solder portion;

a plurality of third terminals positioned in the third terminal paths, each of the third terminals having a third contact portion and a third solder portion; and a metal shell, assembled in the housing, wherein a plug hole and a plug in space are formed in the front end of the combination between the housing and the metal shell, wherein the plug hole extends inward; and the first terminals, and a distance between the first extended part of two adjacent first terminals is greater than the width of the receiving slots of the second terminals; wherein the tongue is assembled to the housing and is located inside the plug in space and the first solder portions of the first terminals extend out of the housing, the second terminals extend into the receiving slots of the tongue module, the second contact portions of the second terminals are exposed out of the lower surface of the tongue module and the second solder portions extend out of the housing; and the plurality of third terminal extend into the third terminal receiving slots of the tongue module, the third contact portions of the plurality of third terminals are exposed below the lower surface of the tongue module and the third solder portions extend out of the housing.

2. The electric connector according to claim 1, wherein the first extended parts of the first terminals and the first contact portions are on the same plane.

3. The electric connector according to claim 1, wherein the tongue module further comprises a half extended board, which is formed by protruding and extending from the base of the housing in the direction of the plug hole, wherein the upper surface of the tongue module is sunken inward in a position corresponding to the half extended board, to form a sunken area and the half extended board is received in the sunken area, one part of each the terminal receiving slots is located on the half extended board and is connected to the third terminal paths, whereas another part of each the third terminal receiving slot is located on the upper surface of the tongue module.

4. The electric connector according to claim 3, wherein the housing has a base with an assembly slot that extends to the front and rear ends of the base, and the third terminal paths and the second terminal paths are respectively located on the upper and lower sides of the assembly slot, the tongue model has an assembly part and a tongue part that extends from the assembly part in the direction of the plug hole, the assembly part is assembled and affixed onto the assembly slot of the housing, and the tongue extends into the plug in space.

5. The electric connector according to claim 4, wherein the assembly part of the tongue module has a plurality of first fixed parts, the housing has a plurality of second fixed parts in the assembly slot and the second fixed parts are positioned onto the first fixed parts.

6. The electric connector according to claim 5, wherein the first fixed parts are clamp holes formed by an inner concave on the lower surface of the tongue module and the second fixed parts are clamp blocks that protrude out of the inner bottom surfaces of the assembly slot and the clamp block and clamp buckle fit in the clamp holes.

7. The electric connector according to claim 5, wherein the tongue module extends downward into a plurality of positioning support blocks and the housing has a plurality of positioning receiving slots that receive the positioning support blocks.

8. The electric connector according to claim 3, wherein the half extended board extends in the direction of the plug hole into a plurality of wedge shaped blocks, the tongue module forms a plurality of wedge shaped holes in positions corresponding to the wedge shaped blocks and the wedge shaped blocks are plugged into the wedge shaped holes.

9. The electric connector according to claim 1, wherein the number of the first terminals is five and except for the first terminal that is located in the center, the remaining first terminals are separately arranged, in pairs of two, on the two opposite sides of the first terminal located in the center, and their shape has a mirror relationship relative to the first terminal located in the center, the first extended parts of the paired first terminals are placed eccentrically to the center of the first contact path and the opposite outer side.

10. The electric connector according to claim 1, wherein the first terminals are configured to be used in conjunction with the second terminals to transmit Universal Serial Bus (USB) 3.0 signals, the second terminals are configured to be used independently to transmit USB 2.0 signals and the third terminal are configured to be used to transmit external serial advanced technology attachment (ESATA) signals.

* * * * *